US005079599A

United States Patent [19]

Kato et al.

[11] Patent Number: 5,079,599

[45] Date of Patent: Jan. 7, 1992

[54] COPYING MACHINE PROVIDING TWO-IN-ONE MODE COPYING OPERATION INCLUDING THE USE OF AN AUTOMATIC DOCUMENT FEEDER

[75] Inventors: Tomokazu Kato, Toyokawa; Masazumi Ito, Toyohashi; Syuzi Maruta, Toyokawa, all of Japan

[73] Assignee: Minolta Camera Kabushiki Kaisha, Osaka, Japan

[21] Appl. No.: 588,192

[22] Filed: Sep. 26, 1990

[30] Foreign Application Priority Data

Sep. 28, 1989 [JP] Japan ..... 1-253506

[51] Int. Cl.[5] ..... G03G 21/00

[52] U.S. Cl. ..... 355/313; 271/9; 271/288; 355/25; 355/321

[58] Field of Search ..... 355/218, 308, 309, 313, 355/317, 321, 244, 24, 25; 271/9, 288, 3.1, 902

[56] References Cited

U.S. PATENT DOCUMENTS

| | | | |
|---|---|---|---|
| 4,052,054 | 10/1977 | Cardwell et al. | 271/277 |
| 4,334,765 | 6/1982 | Clark | 355/244 X |
| 4,708,469 | 11/1987 | Bober et al. | 355/308 X |
| 4,727,401 | 2/1988 | Partilla et al. | 355/319 |
| 4,727,402 | 2/1988 | Smith | 355/321 X |
| 4,731,637 | 3/1988 | Acquaviva et al. | 355/317 |
| 4,745,441 | 5/1988 | Maruta et al. | 355/218 |
| 4,771,319 | 9/1988 | Hamakawa | 355/319 |
| 4,819,029 | 4/1989 | Ito | 355/218 |
| 4,831,414 | 5/1989 | Maruta et al. | 355/219 |
| 4,912,518 | 3/1990 | Matsuo et al. | 355/317 |
| 4,925,176 | 5/1990 | Acquaviva | 271/3.1 |
| 4,941,017 | 7/1990 | Mishima et al. | 355/218 |
| 4,958,198 | 9/1990 | Hamakawa | 355/309 |
| 4,996,568 | 2/1991 | Hamakawa | 355/308 |

FOREIGN PATENT DOCUMENTS 62-47264 2/1987 Japan .

*Primary Examiner*—A. T. Grimley
*Assistant Examiner*—William J. Royer
*Attorney, Agent, or Firm*—Burns, Doane, Swecker & Mathis

[57] ABSTRACT

A copying machine with an ADF has a "two-in-one mode" which is a function to copy images of two sheets of a document set side by side on the platen on a surface of a copy paper with a single scanning process. As document sheets are stored on the document tray facing down, the last page of the document is copied first and the first page of the document is copied last. In the case that odd numbers of document sheets are copied, a blank page interrupts between page 1 and page 2 when the copied papers are bound into a book. This invention provides a copying machine by which a user can select the position of the copied image of the first page or the last sheet of a document on a copy paper.

7 Claims, 20 Drawing Sheets

COPYING MACHINE PROVIDING TWO-IN-ONE MODE COPYING OPERATION INCLUDING THE USE OF AN AUTOMATIC DOCUMENT FEEDER

BACKGROUND OF THE INVENTION

1. Field of the Invention

The present invention relates to a copying machine capable of executing two-in-one mode copying operation with the use of automatic document feeder 2. Description of the Related Arts A copying machine with ADF functioning to set document sheets on predetermined positions of the glass platen and then discharge those document sheets therefrom after scanning for copying. Further, a copying machine with an additional function to carry out "two-in-one mode" to the above copying machine is also devised.

Hereinafter, "two-in-one mode" should be construed as a function mode of that a copying machine with ADF feeds and sets two document sheets side by side on the glass platen and form two images of these documents on a surface of a copy paper with single scanning process.

In known such copying machines, as shown in FIG. 1, documents are stored on a document tray 405 with the document surface to be copied facing down. Thus makes the document being piled up each other so that the first page of documents locates on the bottom position and the final page of documents locates on the top position of the stored documents.

In the copying operation, the documents will be fed from the top sheet of the documents stored on the document tray 405 to the bottom sheet, that is the last page of the document is fed into the copying machine first and the first page of document is fed last. Here, such a copying machine which is instructed to execute "two-in-one" copying operation of the document having odd number sheets on the document tray 405 is studied.

As shown in FIGS. 15 and 17B, the conventional copying machines set the final sheet of document (page: 1, the sheet to be fed in the odd number order) on the right half area adjacent document scale S of document loading area of platen. Therefore, the image of final sheet of document is obtained on the left half area of copy paper as shown in FIGS. 17C and 17D. It is noted that shaded area shown in FIGS. 17C and 17D represent filing margins.

It is also noted that the document scale S is the position on which document sheets fed in even numbered order except the final sheet of document are stopped as shown in FIG. 17A.

To make copied papers obtained in the above mentioned ways be bound into a book, each of copied papers is folded at a center as to coincide its four corners each other so that the copied image is exposed having two filing margins on both sides on which the copied paper is bound.

In this case, a blank page without any image interrupt between page 1 and page 2 when copied papers are bound to a book as shown in FIG. 17C and 17B.

If the page 1 is a so called front page and the substance of document just starts from page 2, such a blank page makes no problem. In other words, such a copying manner as setting the final sheet of document beside the document scale S on the platen and having a blank page between page 1 and page 2 as shown in FIGS. 17C and 17B is preferable.

However, in case that some documents develop the substance from the first page, it is more preferable to set the final sheet of document on the left half area of the platen away from document scale S so as to form the document image on the right half area of copy paper.

Further, in case that copied papers are bound only at the left side, it is preferable to form the image of final sheet of document on the right half area of copy paper as shown in FIGS. 18C and 18D for the sake of recognition.

In consideration of the above studied cases, this invention provides a copying machine by which a user can select the position of copied image of page 1 (the sheet of document finally fed to copying machine) to user's own decision.

SUMMARY OF THE INVENTION

A copying machine comprises a platen for supporting a document sheet to be copied having a first document loading area and a second document loading area, a document tray for storing a plurality of document sheets, document conveying means for successively feeding two document sheets from the document tray to the platen such that odd number sheets and even number document sheets are placed on the first and second document loading areas, respectively.

Such a copying machine also comprises image forming means having first and second image recording areas for forming an image of document sheets placed on the first and second document loading areas on first and second image recording areas, respectively, set mode selecting means for selecting either one of first and second set modes.

The copying machine further comprises first control means for controlling the document conveying means and the image forming means such that when the number of document sheets on the document tray is odd number and the first set mode is selected by the mode selecting means, the final document sheet is set at the first document loading area of platen, and an image of the final document sheet is formed on the first image recording area, and when the number of document sheets on the document tray is odd number and the second set mode is selected by the mode selecting means, the final document sheet is set at the second document loading area, and an image of the final document sheet is formed on the second image recording area.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

A preferred embodiment of a copying machine according to the present invention is described under the following subtitles.

(1) Mechanism of copying machine
(2) Input/Output signals
(3) Position of a filing margin produced on a copy in relative to the position of original documents on a glass platen.
(4) Operation of a copying machine

(1) Mechanism of Copying Machine

Figure 1:
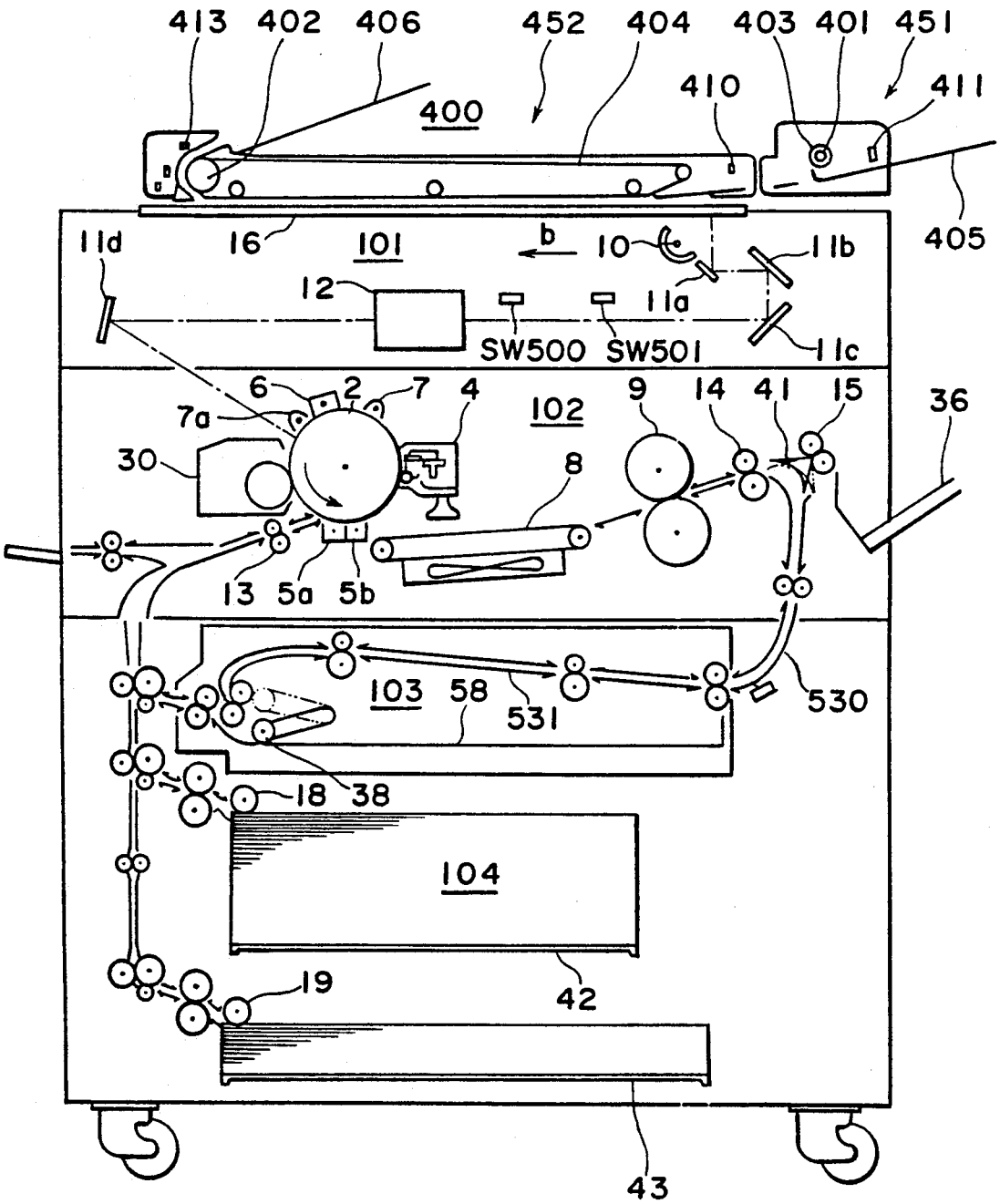
FIG. 1 is a schematic elevational section of a preferred embodiment of the present invention.

Referring to FIG. 1, a preferred embodiment of a copying machine according to the present invention is shown which has a main body and an automatic document feeder (hereinafter referred to as "ADF").

A main body of a copying machine comprises: an optical system 101 in the upper compartment; an image forming part 102 in the middle compartment; a paper re-feeding unit 103 in the lower compartment; and a paper feeding unit 104 in the base compartment.

Furthermore, ADF 400 is mounted onto a glass platen 16 located at top plane of the main body.

<1> Optical System 101

Optical system 101 which is arranged below glass platen 16 to scan the image of the document comprises a light source 10; a set of movable mirrors 11*a*, 11*b* and 11*c*; a projector lens 12 and a fixed mirror 11*d*.

Optical system 101 irradiates the documents through glass platen 16 by a light source 10 and scans an original image on the documents facing to glass platen 16. Further, the original image obtained by scanning is carried by the movable mirrors 11*a*, 11*b* and 11*c*, projector lens 12 and fixed mirror 11*d* so that the original image is focused on a photosensitive drum 2 which is rotatably arranged in the image forming part 102 to rotate in the direction shown by an arrow.

The scanning speed of both light source 10 and movable mirror 11*a* can be given by a formula V/N, wherein V represents the peripheral speed of photosensitive drum 2 and N represents the copying magnification.

Similarly, the scanning speed of movable mirrors 11*b* and 11*c* can be given by a formula V/2N.

The copying magnification N is selectively determined by the position of projector lens 12, and the correction of the image forming position on photosensitive drum 2 is adjusted by the mounting angle of fixed mirror 11*d*.

Switches SW501 and SW500 are sensors to detect predetermined scanned positions of movable mirror.

<2> Image forming part 102

Image forming part 102 which is arranged below optical system 101 to execute an image forming operation based on an electrophotographic image forming process containing procedures of developing an electrostatic latent image formed on photosensitive drum 2 with toner, transferring the developed image to a copy paper, depositing the image on the paper and discharging the copied paper outward.

Image forming part 102 comprises photosensitive drum 2 arranged to rotate in counter-clockwise direction as shown in FIG. 1. Successively arranged around photosensitive drum 2 are: an eraser lamp 7; a main charger 6; an inter-image eraser 7*a*; a developing unit 30 for developing an image with toner; a transfer charger 5*a*; a separating charger 5*b*; and a cleaner 4.

As will be described in details later, the copying machine is equipped with an arrangement for making a filing margin by the control of the timing of turning on and turning off of inter-image eraser 7*a*.

Further provided to the right of separating charger 5*b*, as shown in FIG. 1, are: a conveyer belt 8 for conveying a paper transferred with image; a fixing unit 9 for fixing a toner image on a paper; a pair of conveyer rollers 14 for conveying the paper with the image being fixed; a route change lever 41 for changing the route of paper and a pair of discharge roller 15 for discharging a paper from the machine.

Route change lever 41 is operated by a solenoid (not shown) so as to change the paper route between two kinds. One route is to discharge a copy paper with the fixed image to a discharge tray 36 outwardly extending the copying machine. Another route is to return the copy paper with the fixed image to an intermediate tray 58 for recirculation.

Furthermore, provided to the upper left of transfer charger 5*a*, as shown in FIG. 1, are a pair of timing roller 13 for feeding a copy paper coming from paper feeding unit or to a space defined between photosensitive drum 2 and transfer charger 5*a* in synchronism with the top end of image formed on photosensitive drum 2.

<3>Paper Re-feeding Unit 103

Paper re-feeding unit 103 is arranged below image forming part 102 for the execution of composite copy or duplex copy.

During composite copy operation, a copy paper having an image formed on its first surface goes through a paper path 530, which is established by the turning of a changeover lever (not shown) in one direction, to intermediate tray 58 where the copy paper is temporarily stored with the first surface face down.

During duplex copy operation, a copy paper having an image formed on its first surface goes through paper paths 530 and 531, which are established by the turning of the changeover lever in another direction, to intermediate tray 58 where the copy paper is temporarily stored with the second surface opposite to the first surface face down.

The copy paper temporarily stored in intermediate tray 58 is then fed out therefrom by a re-feeding roller 38 in a predetermined timing. The copy paper thus fed out is conveyed to timing roller pair 13 for carrying out the image forming process again.

The copy paper re-fed from intermediate tray 58 to the space between photosensitive drum 2 and transfer charger 5*a* such that the first surface of paper faces photosensitive drum 2 in the case of composite copy operation, and faces transfer charger 5*a* in the case of duplex copy operation.

<4> Paper Feeding Unit 104

Paper feeding unit 104 has an upper paper magazine 42 and a lower paper magazine 43 which are arranged below paper re-feeding unit 103, for storing two different size copy papers, respectively.

Copy papers stored in upper paper magazine 42 and those stored in lower paper magazine 43 are fed out selectively and one at a time by paper feed rollers 18 and 19, respectively.

Each copy paper thus fed out from upper paper magazine 42 or lower paper magazine 43 is conveyed to timing roller pair 13 by an automatic paper feeding mechanism for carrying out the image forming process in the same manner described above.

<5> ADF 400

The automatic document feeder (ADF) generally comprises a document table unit 451 including document tray 405, a document feeding roller 403, a document feeding roller driving motor 401 and a document sensor 411 to detect the presence of the document in document tray 405, and a document feed unit 452.

The document feed unit 452 disposed on glass platen 16 includes a document feed sensor 410, a document transporting belt 404, a document transporting belt driving motor 402, a document discharge sensor 413 and a document discharge tray 406.

Figure 10A:
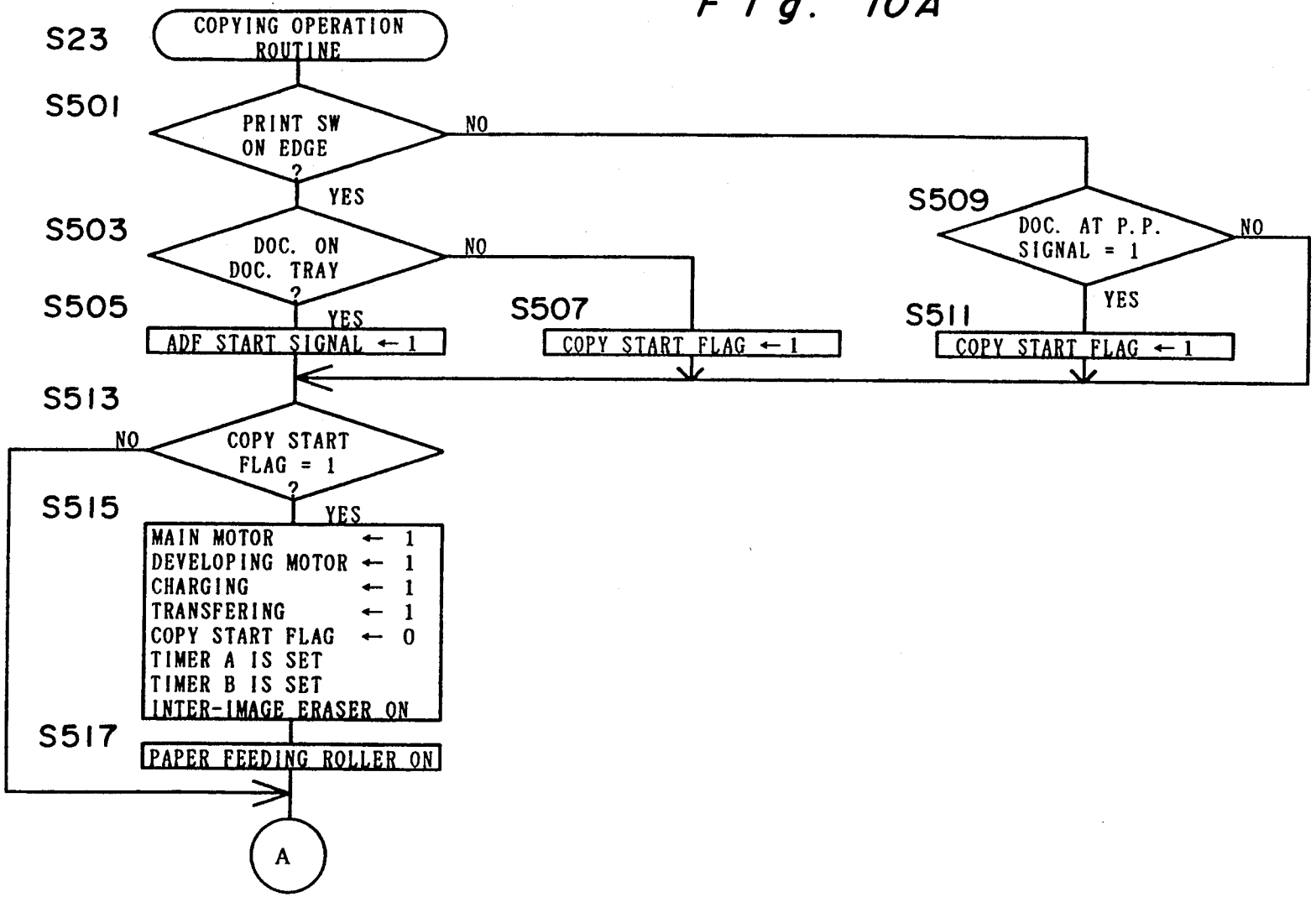
FIG. 10A, 10B, 10C and 10D are flow chart of copying mode routine, shown in main routine of FIG. 5, of the present invention.
Figure 10B:
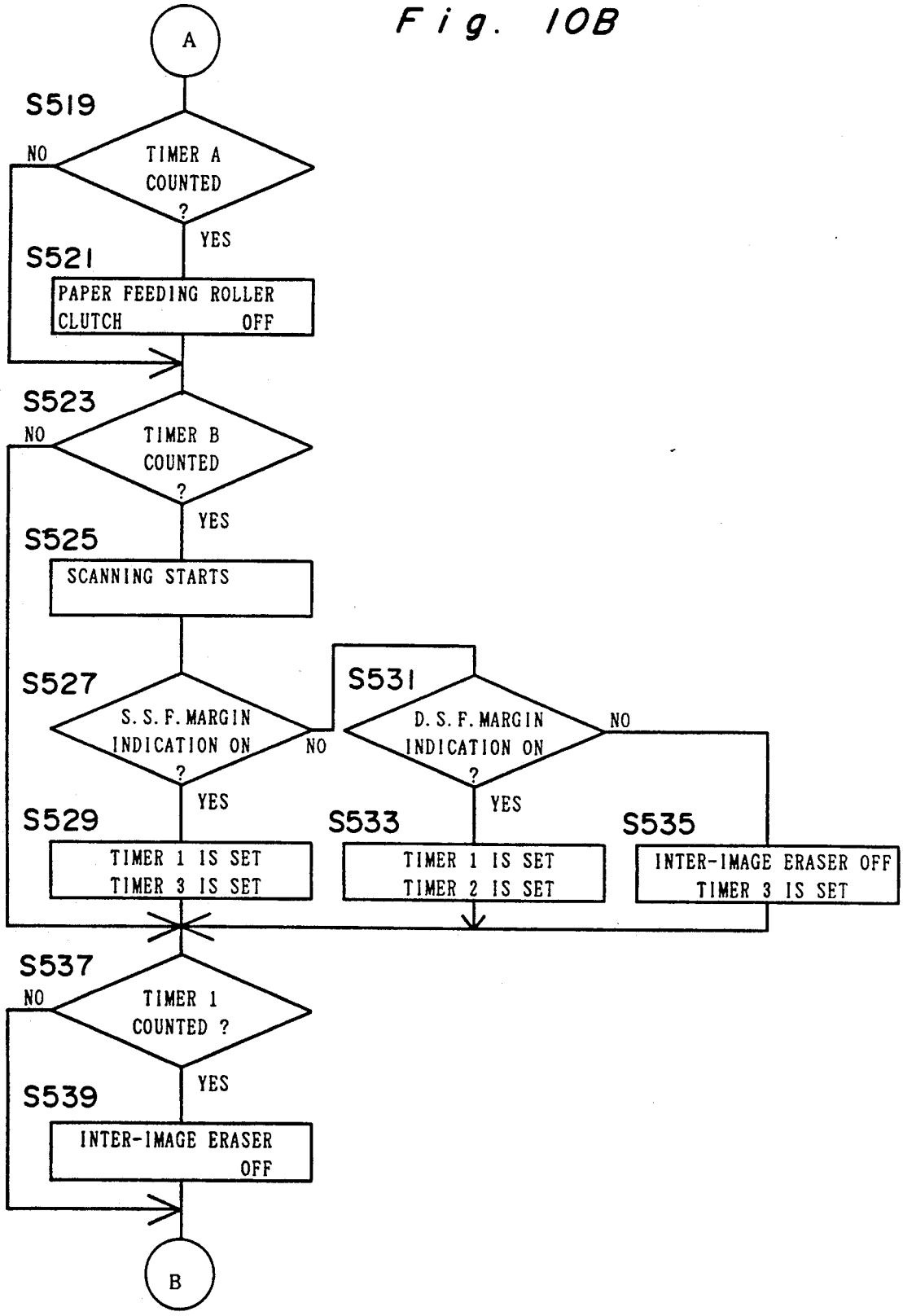
Figure 10C:
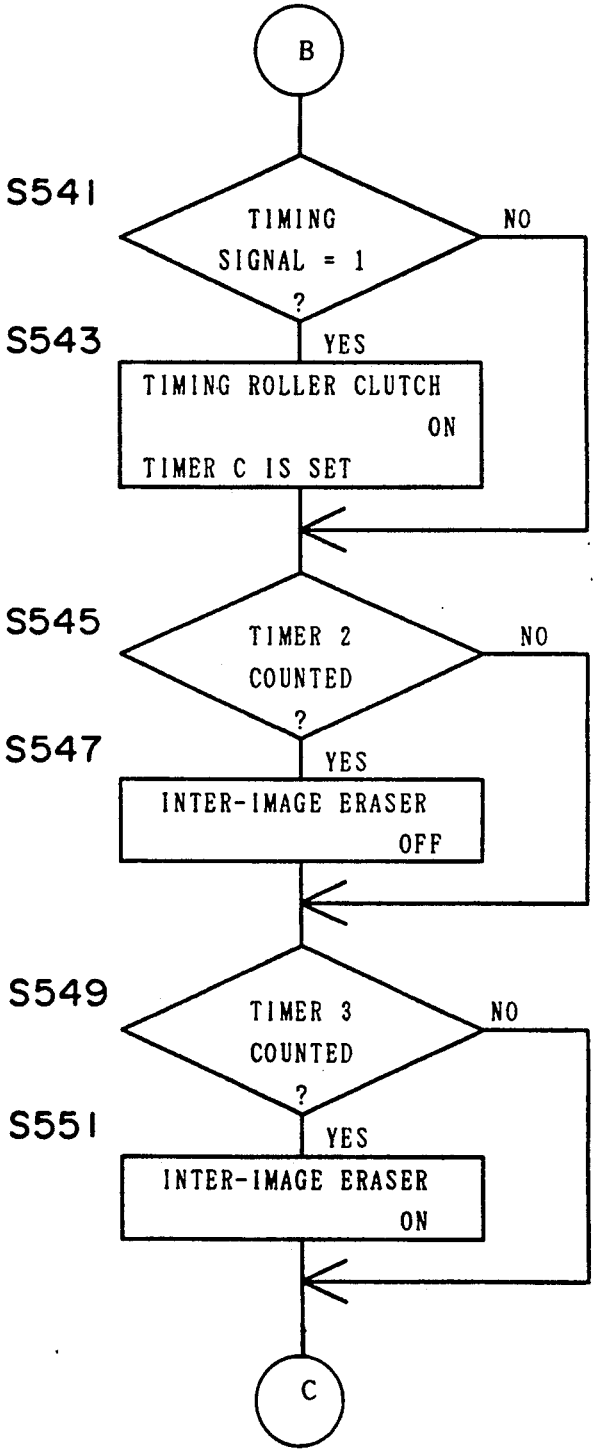
Figure 10D:
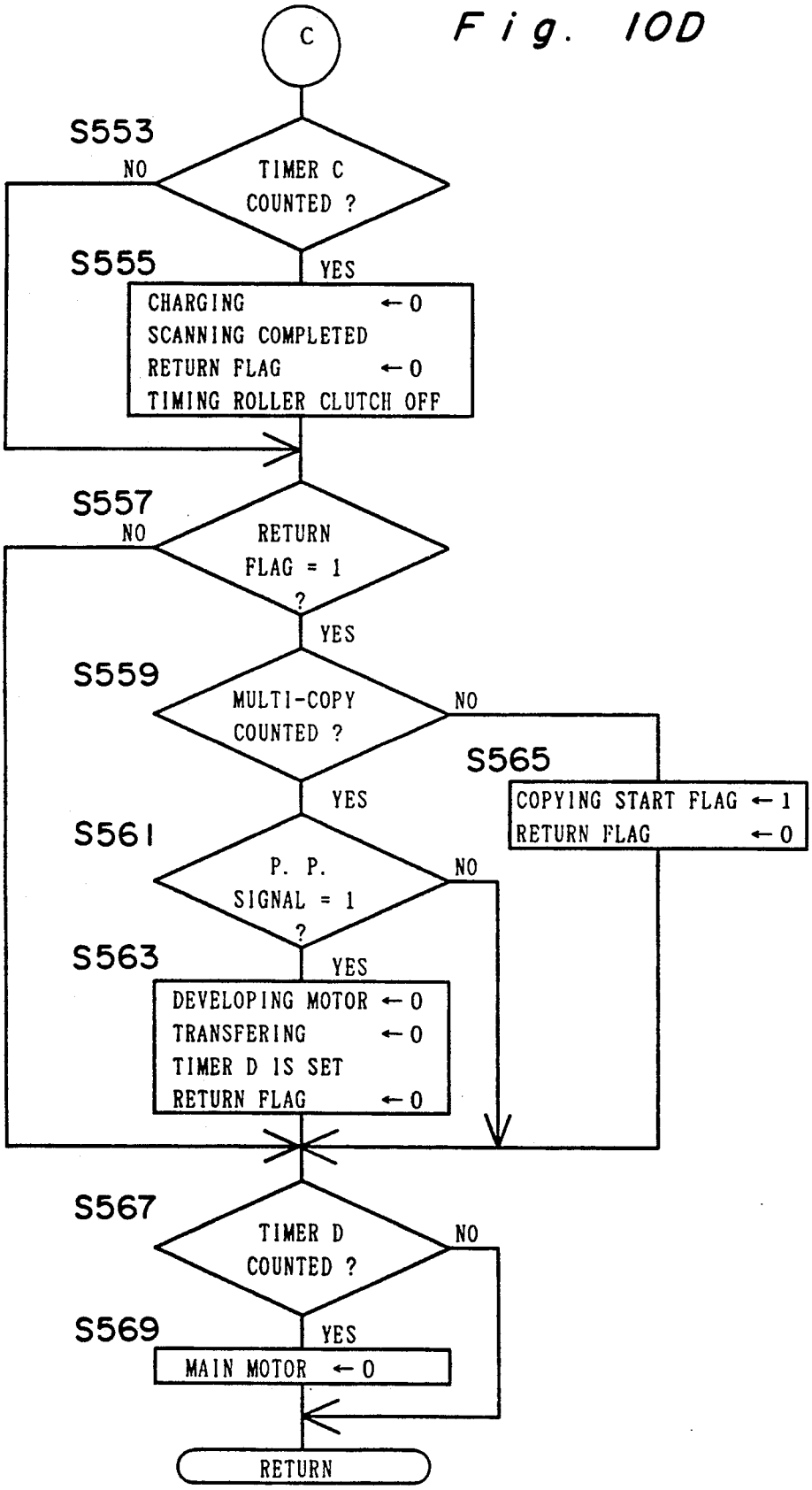
Figure 12:
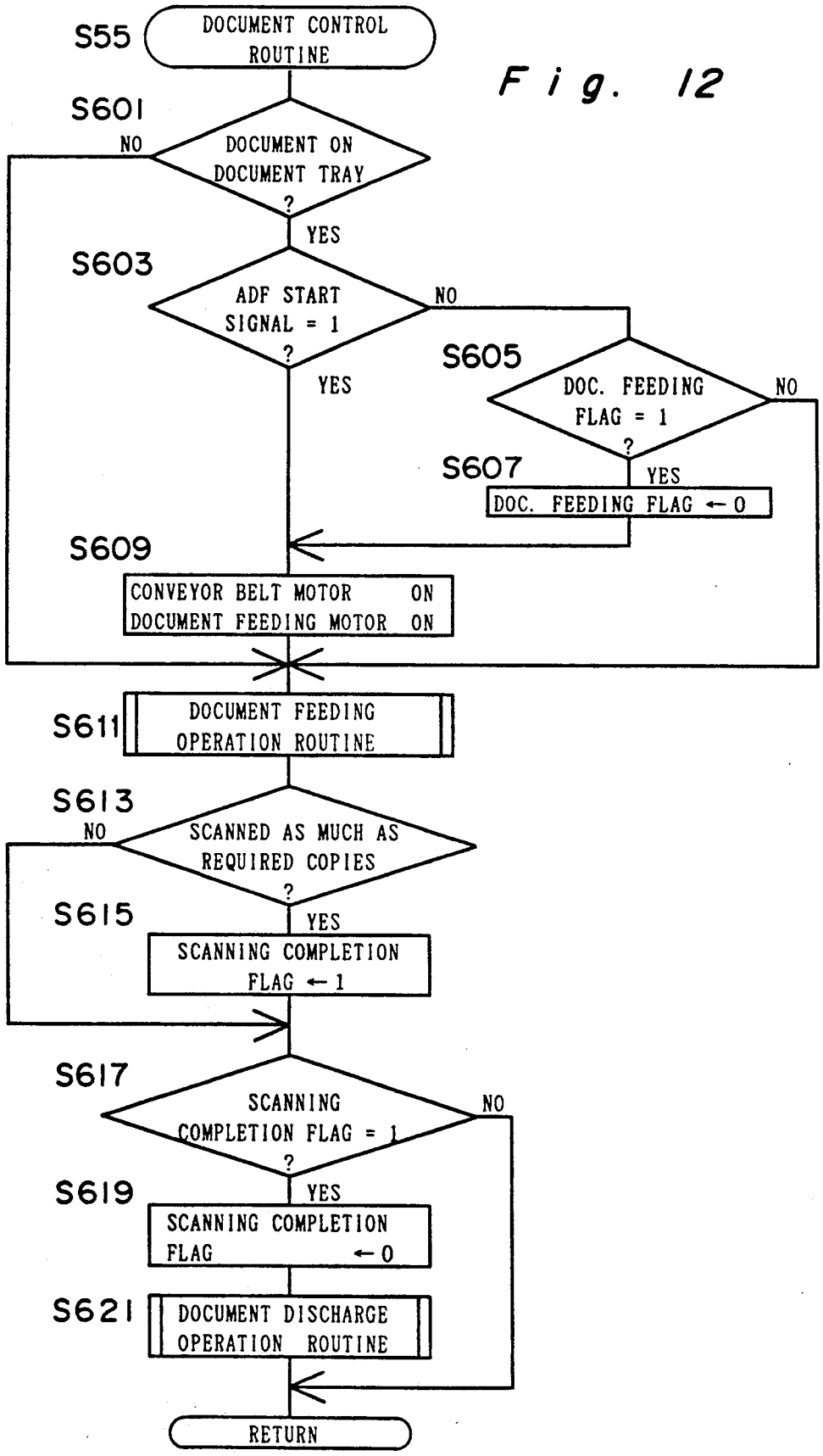
FIG. 12 is a flow chart of controlling original document mode routine, shown in ADF operation mode routine of FIG. 11, of the present invention.

As shown at step S603 in FIG. 12, ADF 400 starts to feed a document in response to an ADF start signal produced by CPU 201 (FIG. 3), which controls the main body of the copying machine. When a document is fed and placed at the predetermined position on glass platen 16, a detection signal indicative of the document being located at the predetermined position is applied to CPU 201 on main body (step S851 in FIG. 13B), whereupon the main body is enabled to start copying operation (S509 in FIG. 10A).

(2) Input/Output Signals

Figure 2:
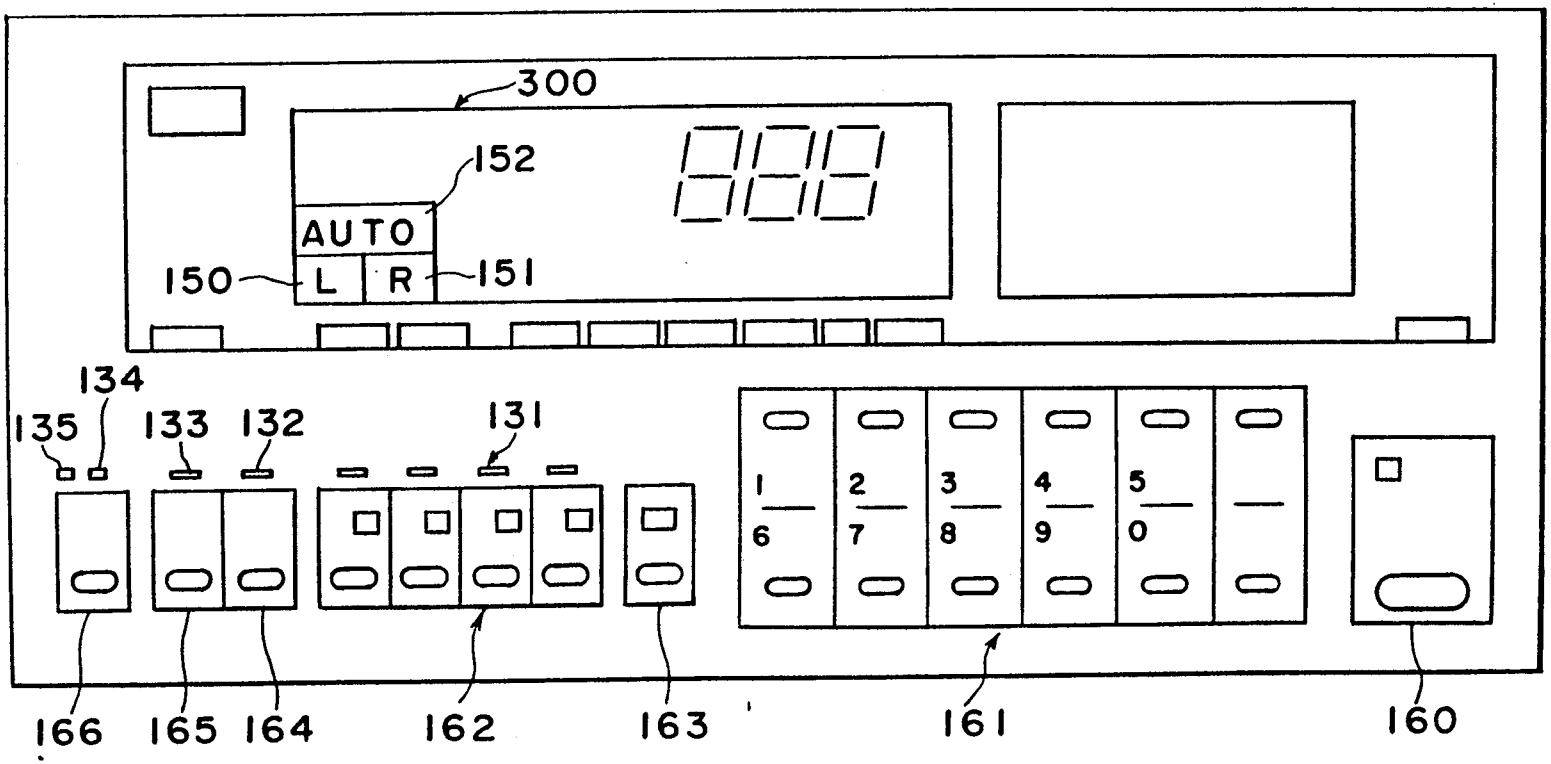
FIG. 2 is a schematic plan view of a control panel adapted for controlling several main components of the present invention.
Figure 3:
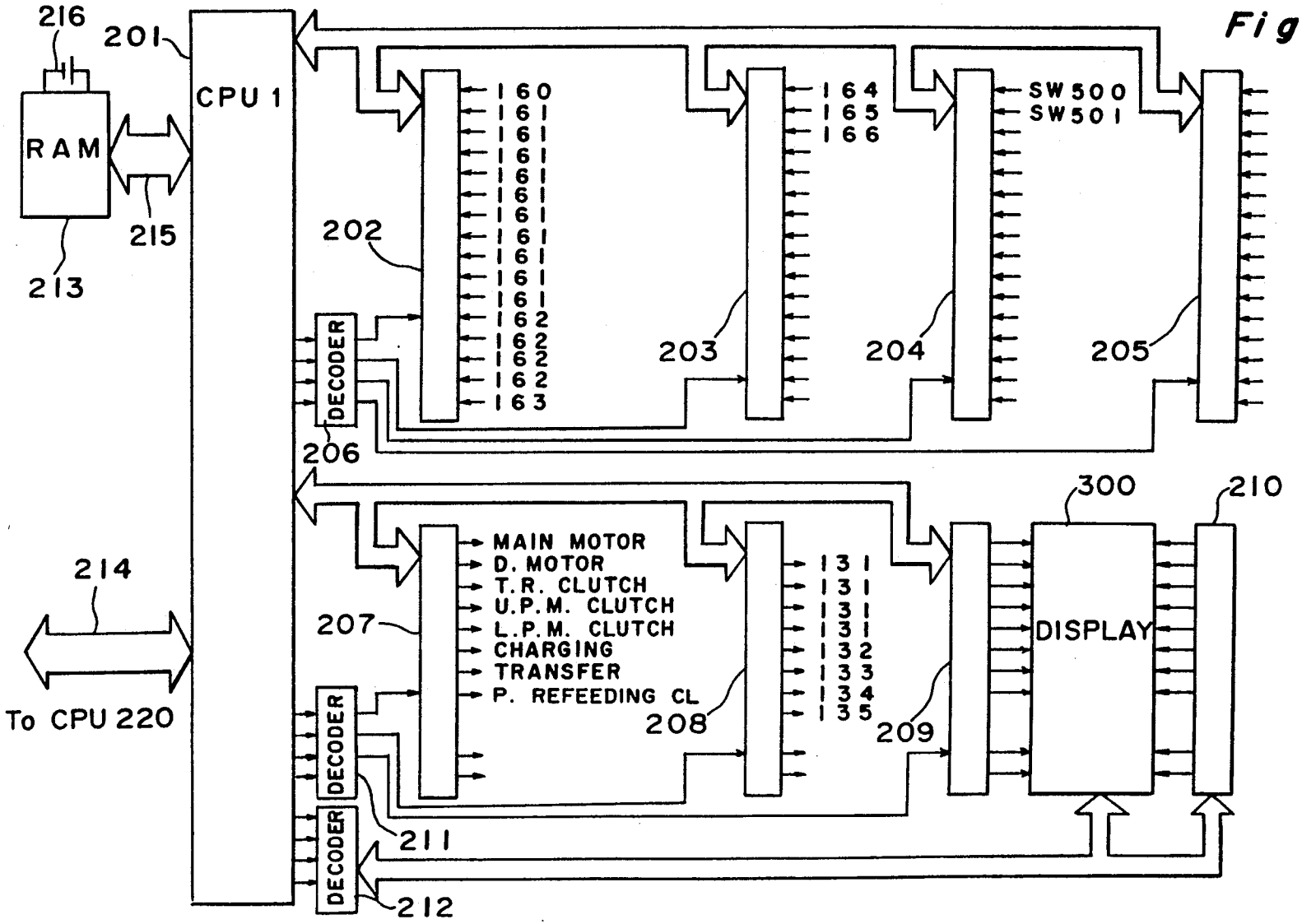
FIG. 3 is a block diagram showing the constitution of a control unit for controlling the coping cabinet of the present invention shown in FIG. 1.
Figure 4:
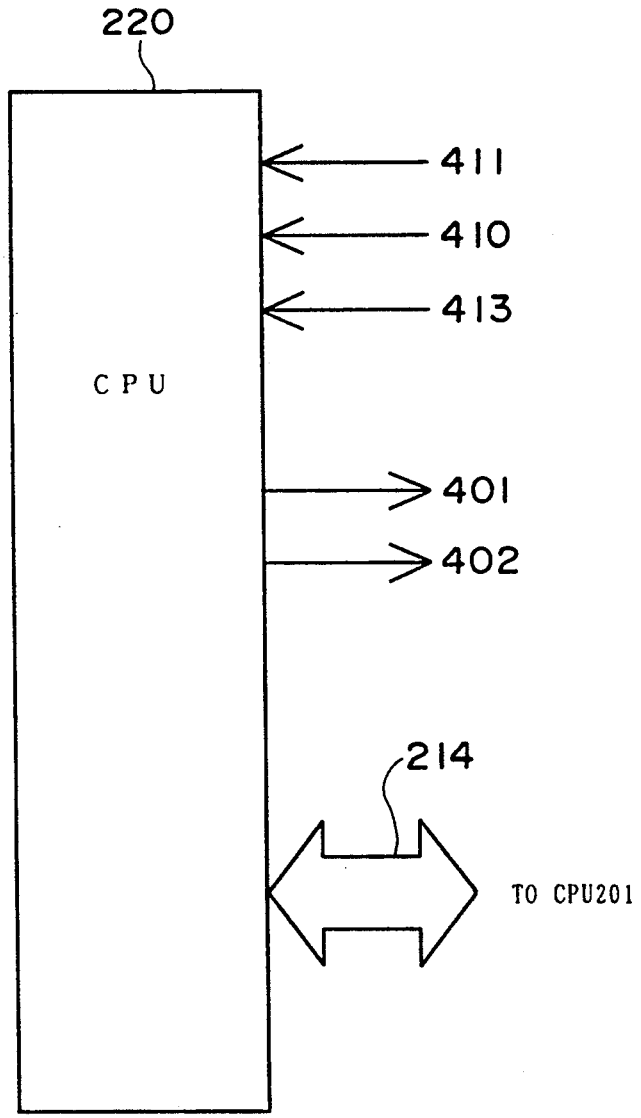
FIG. 4 is a block diagram showing the constitution of a control unit incorporated into a automatic document feeder unit of the present invention shown in FIG. 1.

With reference to FIGS. 2, 3 and 4, signals applied to and produced from the copying machine of the embodiment will be explained hereinbelow.

<1> Control Panel: FIG. 2

As shown in FIG. 2, the control panel has the following operation keys and display LEDs: a print key 160 for providing a command to the copy machine to start the copying operation; a group of ten keys 161 for entering numeric data; a group of magnification selection keys 162; a group of magnification factor indication LEDs 131 for indicating the selected magnification rate; a two-in-one key 164 for providing a command to set the two-in-one mode; a two-in-one mode indication LED 132 for indicating the two-in-one mode when it is selected; a duplex copy key 165 for providing a command to set the duplex copy mode; a duplex copy indication LED 133 for indicating the duplex copy mode when selected; a filing margin key 166 for setting sequentially in the order of a single side filing margin mode, a double sides filing margin mode and reset in response to each key depression; a single side filing margin indication LED 134 for indicating that the single side filing margin mode is selected; a double sides filing margin indication LED 135 for indicating that the double side filing margin mode is selected; and a final document location key 163 for selecting the position of the final document on glass platen 16. To be at a first position i.e., at the right half of glass platen 16 adjacent to a document scale S (the image will be formed on the left half side of a copy paper) or at a second position, i.e. at the left half of glass platen 16 (the image will be formed on the right half side of a copy paper) or at an automatically selected position automatically selected by the copying machine.

Provided in a displaying part 300 are: an L-indicator 150 which indicates that the final document will be located on the right half adjacent to document scale S of glass platen 16 to form the image on the left half of a copy paper; an R-indicator 151 which indicates that the final document will be located on the left half of glass platen 16 to form the image on the right half of a copy paper; and AUTO-indicator 152 which indicates that the location of the final document will be automatically designated by the copying machine.

L-indicator 150, R-indicator 151 and AUTO-indicator 152 illuminate one at a time sequentially in said order in response to each depression of final document location key 163.

<2> Control circuit: FIGS. 3 and 4

In the copying machine, CPU 201 (FIG. 3) and CPU 220 (FIG. 4) receive signals from the control panel entered by the key depression and also from sensors incorporated in the copying machine. As will be described later, these CPUs execute various processing of those signals according to the flow charts to control the movement of various driving parts as well as the indication on the control panel.

Control circuit is essentially constructed by CPU 201 for controlling the main body and CPU 220 of controlling ADF 400.

Signals from the key switches 160 to 166 and signals from switches SW500 and SW501 enter CPU 201 through expanded input ICs 202 to 205 which are controlled by decoder 206.

CPU 201 provides control signals, through expanded output ICs 207 to 210 controlled by decoders 211 and 212, to LEDs 131 to 135 on the control panel, to displaying part 300, and also to driving parts of the main body such as main motor, developing motor, timing roller clutch, upper paper magazine clutch, lower paper magazine clutch, transferring charger, charger and paper re-feeding clutch.

CPU 201 is linked through a bus 215 with CPU 220 to communicate with CPU 220 and also connected with a RAM 213 which is being backed-up with a battery 216.

CPU 220 communicates with CPU 201 through a bus 214 and receives signals from document sensor 411, document feed sensor 410 and document discharge sensor 413 which are incorporated in ADF 400.

CPU 220 provides control signals to document feeding roller driving motor 401 and also to document transporting belt driving motor 402.

(3) Filing Marginal Position on a Copy Paper and Setting Position of Original Documents on Glass Platen 16

The copying machine according to the embodiment described above can form a filing margin either on one side or both sides of a copy paper.

Furthermore, the copying machine can provide the last page of the document to be formed on the left side or right side of the copy paper, selectively or automatically.

<1> Filing Marginal Position on a Copy Paper

Filing margin on a copy paper is formed by the step of discharging a portion of photosensitive drum 2 corresponding to a desired filing margin, with inter-image eraser *7a*, such that the discharged portion on photosensitive drum 2 will not receive any toner to provide a clear and non-copied area thereof.

Timers 1 to 3, described later, control the turning on and off of inter-image eraser *7a*.

Figure 15:
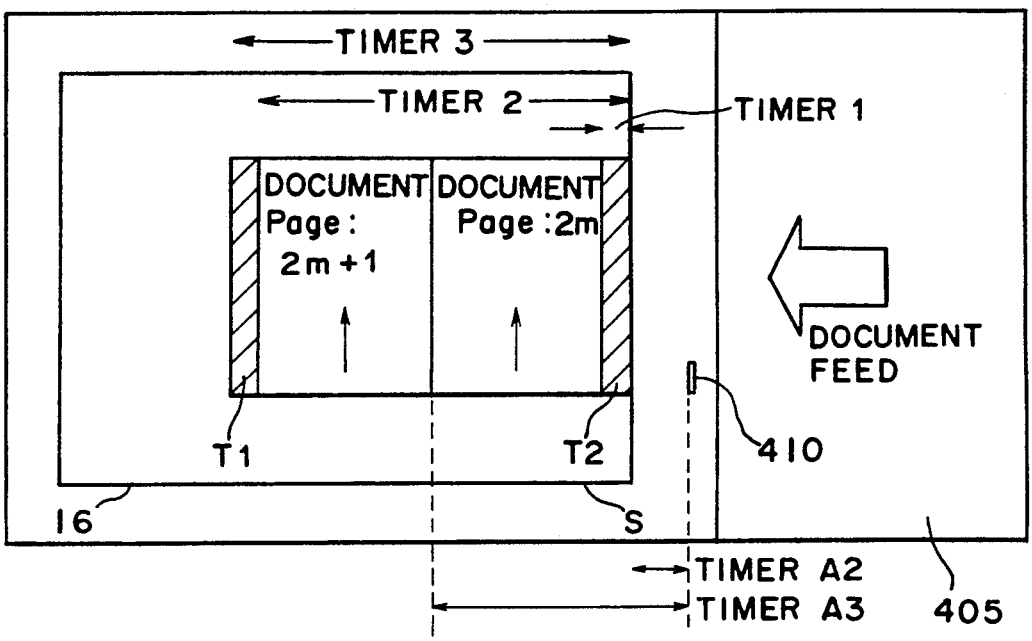
FIG. 15 is an illustration of assistance in explaining the relationship between the position of original document fed on a glass platen by ADF and the timers shown in the above mentioned flow charts of the present invention.
Figure 16A:
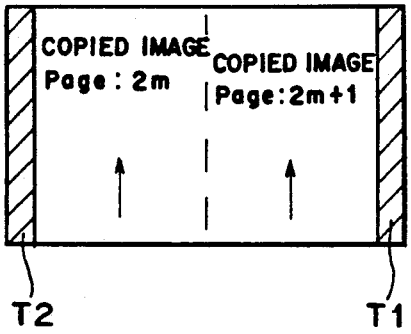
FIGS. 16*a* and 16*b* are an illustration of assistance in explaining an example produced by forming double sides filing margin mode of the present invention.
Figure 16B:
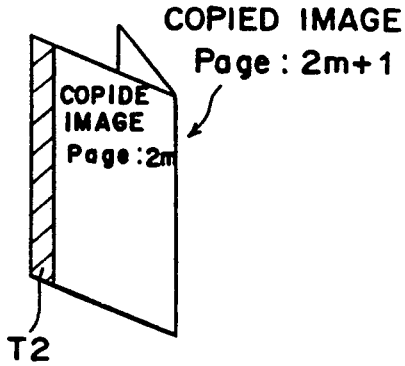

For example, to form a filing margin only on the top end portion of the copied image (a single side filing margin mode), the charged portion corresponding to a filing margin T2 (FIG. 15) on photosensitive drum is erased by the turn on of inter-image eraser *7a* during the counting of timer 1. It is noted that a filing margin T2 is formed on the left side of the copy paper, as shown in FIG. 16, because the document image and copied image are in upside down relationship with each other.

Furthermore, to form filing margins on both sides of the copied image (a double sides filing margin mode), the charged portion in corresponding to filing margins T2 on photosensitive drum are erase by the turn on of inter-image eraser *7a* during the counting of timer and during the time after the count up of timer 2.

Details of the file margin forming will be described later.

To form filing margins on the copied image, the utilization of other methods than the above is also useful such as by changing the magnification factor (reduction copy), or by changing the copy paper size, or by changing the scanning position of the document.

<2> Position to Set a Document

Figure 17A:
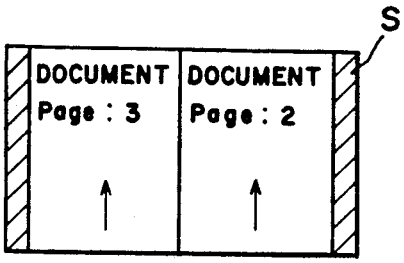
FIGS. 17*a*, 17*b*, 17*c* and 17*d* are an illustration of assistance in explaining the relationship between the positions of original documents fed on a glass platen and the positions of copies produced copies image produced by forming double sides filing margin mode of the present invention.
Figure 17B:
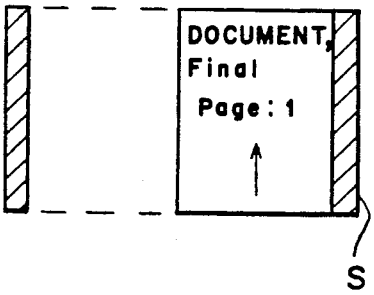
Figure 17C:
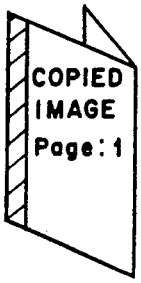
Figure 17D:
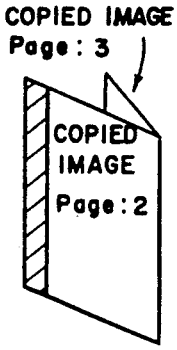
Figure 18A:
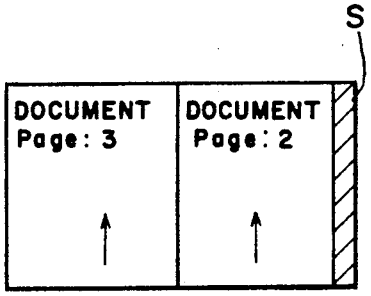
FIGS. 18*b*, 18*c* and 18*d* are an illustration of assistance in explaining the relationship between the positions of original documents on a glass platen and the positions of copied image and file margin produced by forming single side filing margin mode of the present invention.
Figure 18B:
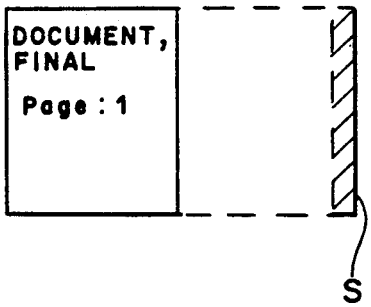
Figure 18C:
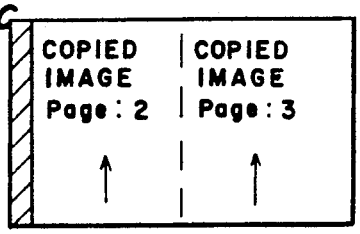
Figure 18D:
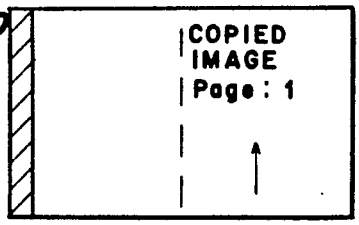

When odd numbers of document are placed on ADF, either one of two different settings of the final document on glass platen 16 is possible by the operation of final document set key 163. The first setting is to place the final document on the right half area of glass platen 16 adjacent a document scale S in order to form the document image on the left half of a copy paper as shown in FIGS. 17B and 17C. The second setting is to place the final document on the left half area of glass platen 16 away from the document scale S in order to form the document image on the right half of a copy paper as shown in FIG. 18B and 18D.

To place the final document on the right half area of glass platen 16 adjacent document scale S, document transporting belt driving motor 402 for conveying the document is turned off after the elapse of a predetermined time counted by timer A2 from a time when document feed sensor 410 detects the trailing end of the document sheet (i.e. from the off edge of document feed sensor 410).

To place a final document on the left half area of glass platen 16 away from document scale S, document transporting belt driving motor 402 for conveying the document sheet is turned off after the elapse of a predetermined time counted by timer A3 from a time when document feed sensor 410 detects the trailing end of the document sheet.

The details for controlling the setting position of a document sheet on glass platen 16 will be described later in connection with FIG. 13.

(4) Operation of a Copying Machine

Next, the operation of the copying machine is explained according to the processing of the CPUs.

It is noted that terms "ON EDGE" and "OFF EDGE" are used to indicate times when the signal state is switched from OFF to ON and from ON to OFF, respectively.

(A) CPU 201 provided in the Main Body

<1> Main Routine

Figure 5:
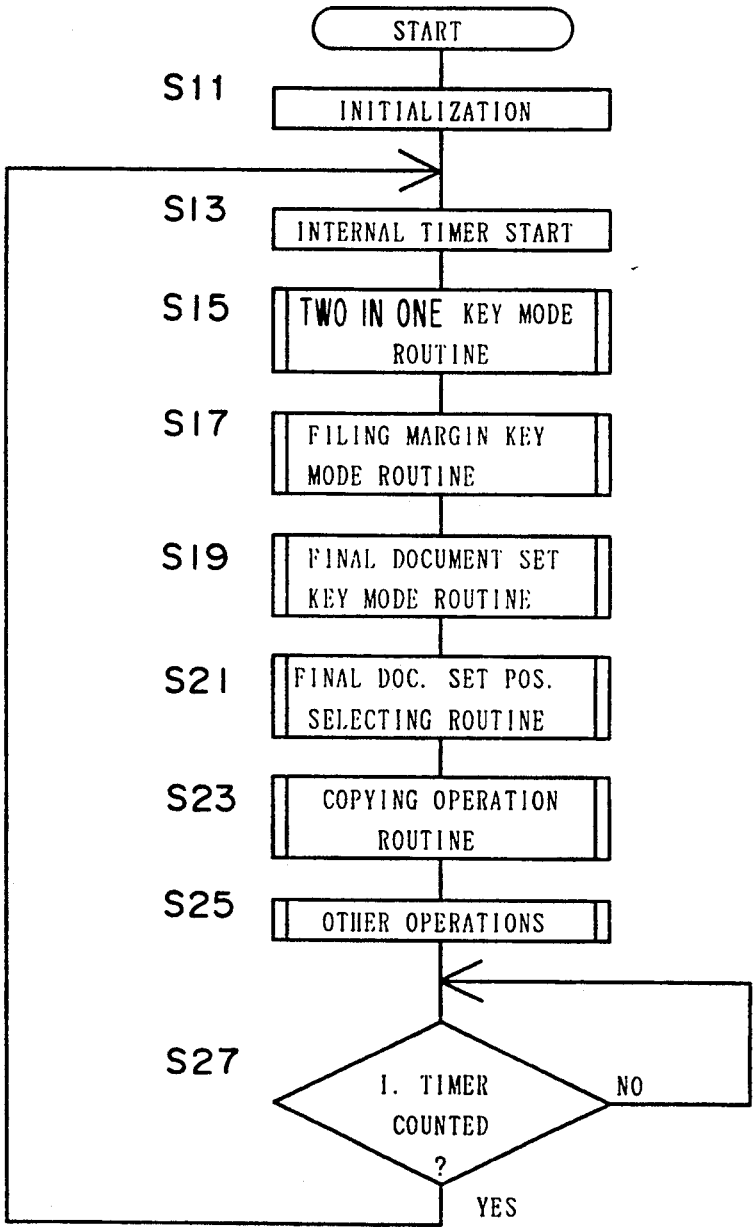
FIG. 5 is a flow chart of main control routine to be executed by the central processing unit (hereinafter referred to as "CPU") of the main control unit of FIG. e to control the main operations of the copying machine of FIG. 1 of the present invention.

Referring to FIG. 5, a flow chart of a main routine to be executed by CPU 201 for the control of main body is shown.

When the copying machine is connected to a power source, CPU 201 starts initialization operation such as clearing of RAM 213 (step S11).

Then, an internal timer for determining the cycle time of the routine is started (step S13). Thereafter, the following routines are carried out. A filing margin key mode routine; a two-in-one key mode routine (step S15, two-in-one key mode is set or cleared according to the input signals entered by two-in-one key 164); a filing margin mode routine (step S17, filing margin mode is set or cleared according to the input signals entered by filing margin key 166); a final document set key mode routine (step S19, the final document position is selected ); a final document set position selecting routine (step S21, when "AUTO" is selected, the position of the final document to be placed on glass platen 16 is determined according to the selected filing margin); a copying operation routine (step 23, operation to control copying procedures); and other necessary routines.

After the foregoing routines are completed and when the internal timer counts up at step S27, the operation returns to step S13 and repeats the above routines.

<2> Two-In-One Key Mode Routine

Figure 6:
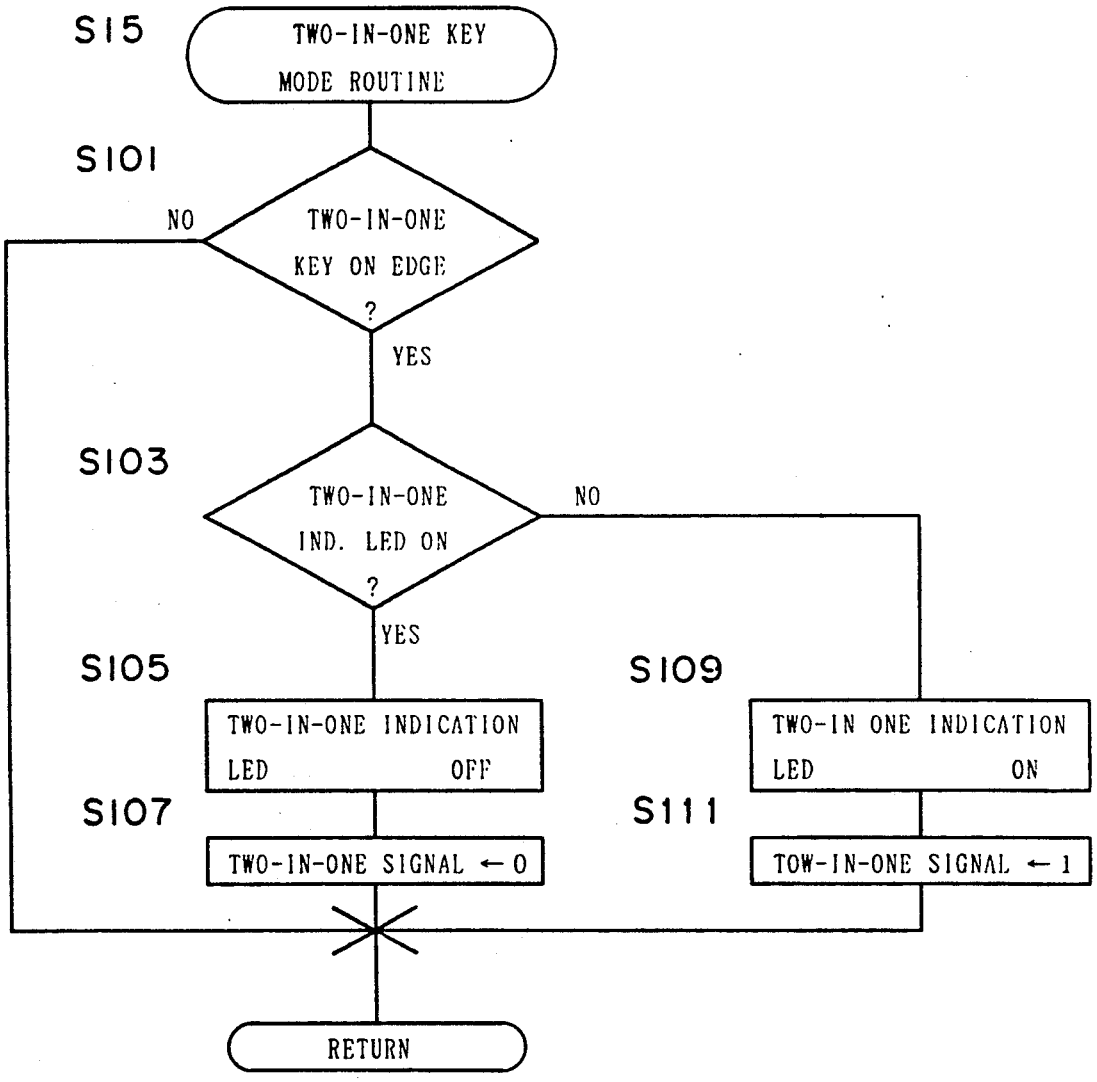
FIG. 6 is a flow chart of Two-in-one mode operation of the present invention.

Referring to FIG. 6, a flow chart of operations executed in step S15 is shown. The flow chart of FIG. 6 is executed in response to an input signal entered by two-in-one key 164.

Upon detection of "ON EDGE" of two-in-one key 164 ("YES" at step S101), the previous mode which has been carried before the detection of the "ON EDGE" of the two-in-one key is judged (step S103).

When the judged previous mode is two-in-one mode ("YES" at step S103), the two-in-one key mode is cleared, and two-in-one indication LED 132 representing the two-in-one key mode is turned off (step S105). Then, two-in-one signal transmitted to CPU 220 for the control of ADF is set to zero (step S107).

When the previous mode is not two-in-one mode ("NO" at step 103), two-in-one mode is set, and two-in-one indication LED 132 representing the two-in-one mode is turned on (step S109). Then, two-in-one signal transmitted to CPU 220 for the control of ADF is set to one (step S111).

<3> Filing Margin Key Mode Routine

Figure 7:
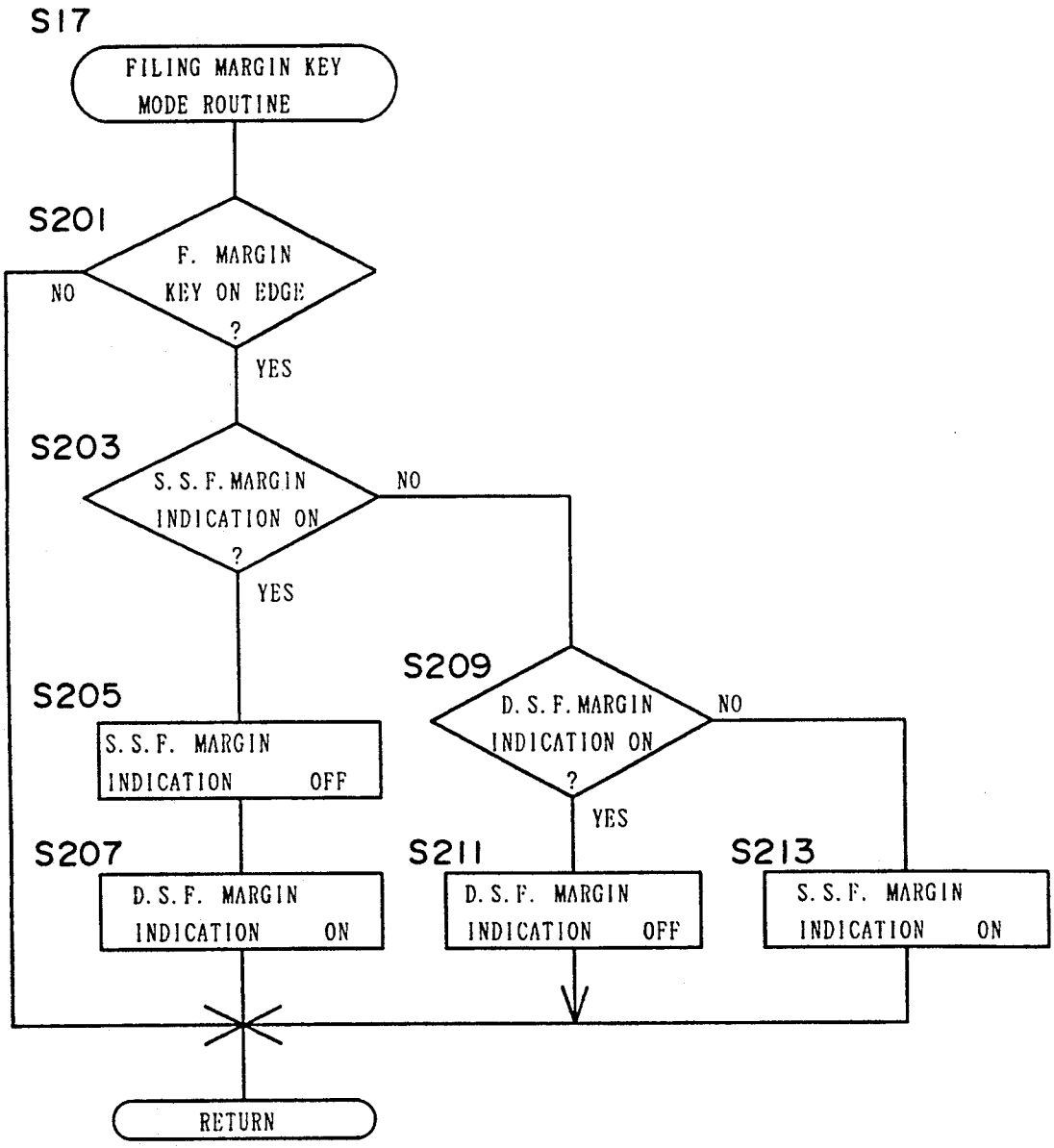
FIG. 7 is a flow chart of filing margin forming mode operation of the present invention.

Referring to FIG. 7, a flow chart of operations executed in step S17 is shown. The flow chart of FIG. 7 is executed in response to an input signal entered by filing margin key 166.

Upon detection of "ON EDGE" of filing margin key 166 ("YES" at step S201), the previous mode which has been carried out before the detection of "ON EDGE" of the filing margin key is judged (steps S203 and S209).

When the current mode is on single side filing margin mode ("YES" at step S203), the single side filing margin mode is cleared, and single side filing margin indication LED 134 representing the single side filing margin mode is turned off (step S205). Then, double sides filing margin mode is set, and double sides filing margin mode LED representing double sides filing margin mode is turned on (step S207).

When the previous mode is double sides filing margin mode ("YES" at step S209), double sides filing margin mode is cleared and double sides filing margin mode LED 135 representing the double sides filing margin mode is turned off (step S211).

When the previous mode is neither single side filing margin mode nor double sides filing margin mode ("NO" at steps S203 and S209), the single side filing mode is set and single side filing margin LED representing the single side filing margin mode is turned on (step S213).

<4> Final Document Set Mode Key Routine

Figure 8:
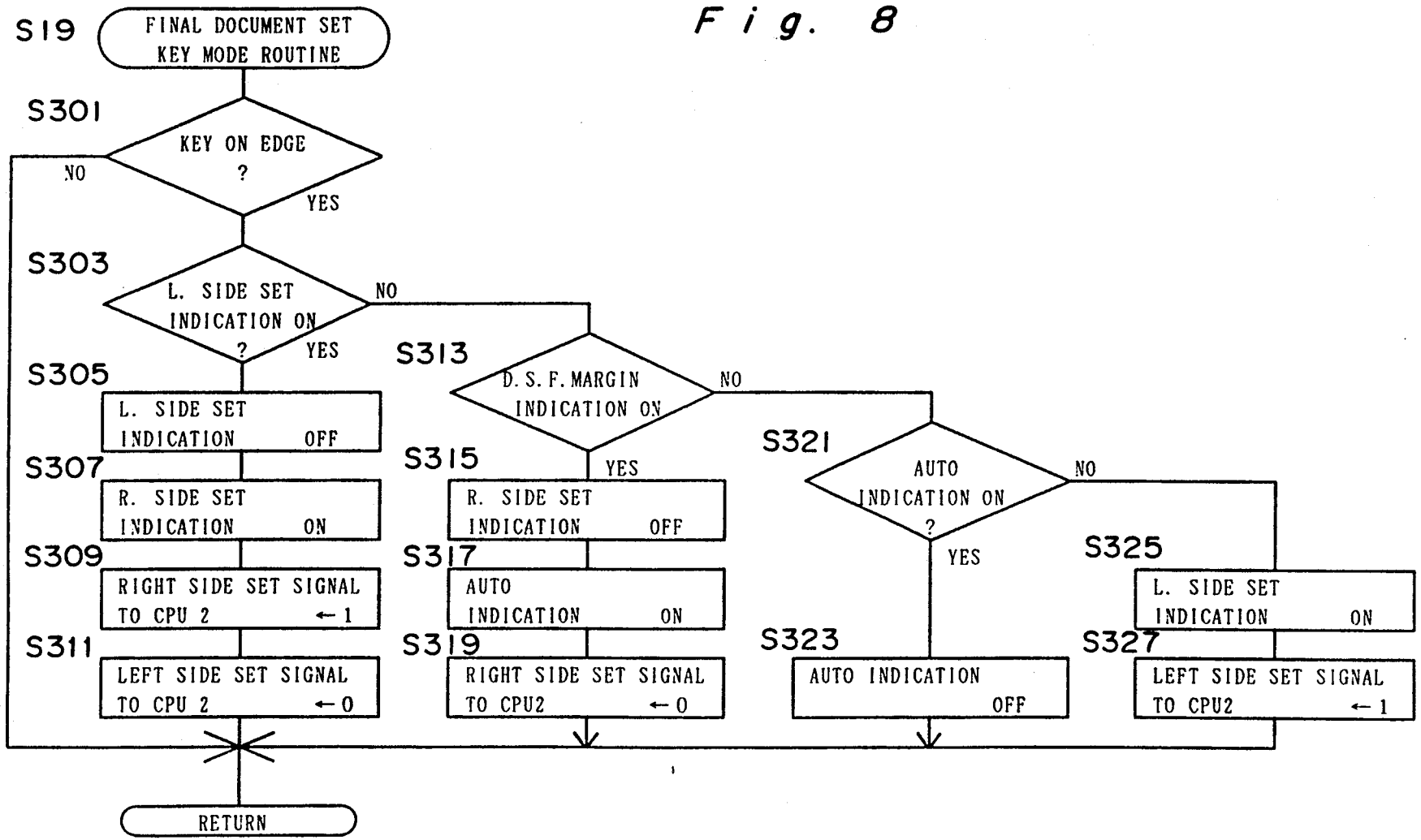
FIG. 8 is a flow chart of final original document setting mode operation of the present invention.

Referring to FIG. 8, a flow chart of operations executed in step S19 is shown. The flow chart of FIG. 8 is executed in response to an input signal entered by final document set key 163.

Upon detection of "ON EDGE" of final document set key 163 ("YES" at step S301), the previous mode is judged (steps S303 and S313).

When the detected previous mode is left side set mode ("YES" at step S303), left side set mode is cleared, and L-indicator 150 representing the left side set mode is turned off (step S305). Then, right side set mode is set, and right side set indication representing the right side set mode is turned on (step S307). Furthermore, the right side set signal and the left side set signal transmitted to CPU 220 are set to one (step S309) and to zero (step S311), respectively.

When the detected previous mode is right side set mode ("YES" at step S313), the right side set mode is cleared, and the R-indicator 151 for representing the right side set mode is turned off (step S315). Furthermore, "AUTO" is set, and AUTO-indicator 152 representing the AUTO mode is turned on (step S317) and the right side set signal transmitted to CPU 220 for the control of ADF is set to zero (step S319).

When the detected previous mode is AUTO mode ("YES" at step S321), AUTO mode is cleared, and AUTO-indicator 152 representing the AUTO mode is turned off (step S323).

When the detected previous mode is neither left set mode, nor right set mode nor AUTO mode ("NO" at steps S303, S313 and S321), the left side is set, and the left side set indication representing left side set mode is turned on (step S325). Furthermore, left side set signal transmitted to CPU 220 for the control of ADF is set to one (step S327).

<5> Final Document Set Position Selecting Routine

Figure 9:
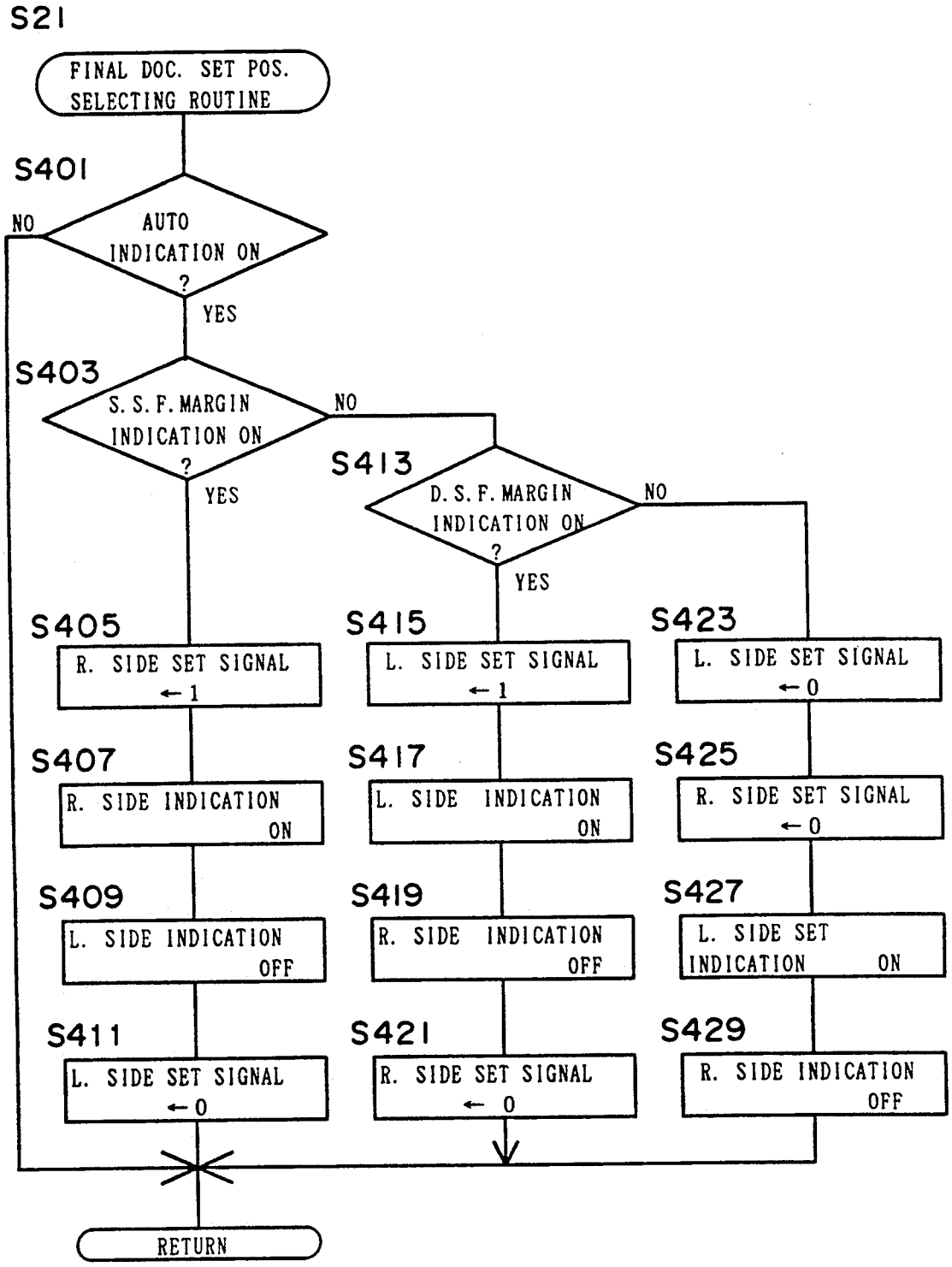
FIG. 9 is a flow chart of setting position of final document mode selecting routine, shown in main routine of FIG. 5, of the present invention.

Referring to FIG. 9, a flow chart of operations executed in step S21 is shown. The flow chart of FIG. 9 is executed when AUTO is selected.

If single side filing margin mode is set when AUTO is being selected ("YES" at step S401), right side set signal transmitted to CPU 220 for the control of ADF is set to one (step S405) and R-indicator 151 is turned on (step S407). Thus, the image of final document will be copied on the right half side of a copy paper. Furthermore, the left side set signal is set to zero (step S411) and L-indicator 150 is turned off (step 409).

When double sides filing margin mode is set ("YES" at step S413), the left side set signal transmitted to CPU 220 for the control of ADF is set to one (at S415), and L-indicator 150 is turned off (step S417). Furthermore, the right set signal is set to zero (step S421) and R-indicator 151 is turned off (step S419).

When neither single side filing margin mode nor double sides filing margin mode is set ("NO" at steps S403 and S413), the left side set signal and the right side set signal are set to zero, and L-indicator 150 and R-indicator 151 are turned off (step at S427 and S429). In this case, the image of the final document will be copied on the left half side of a copy paper (steps S817, S821 and S819 in FIG. 13A).

<6> Copying Operation Routine

Referring to FIGS. 10A, 10B 10C and 10D, a flow chart of operations executed in step S23 is shown. Steps S501 to S511 are operations to start the copying procedures.

If "ON EDGE" of print switch 160 is judged ("YES" at step S501) when documents are being set on document tray 405 ("YES" at step S503), ADF start signal transmitted to CPU 220 is set to one (step S505). Then, feeding of the document sheet begins on ADF 400 side (step S603).

Furthermore, if "ON EDGE" of print switch 160 is judged ("YES" at S501) when no document is set on document tray 405 ("NO" at step S503), the copy start flag is set (step S507), and copying procedures starts immediately.

When a document is set at a predetermined position on glass platen 16 by ADF 400 ("YES" at S509, see step S851), a document position signal indicating that the document is set at a predetermined position on platen 16 is transmitted from CPU 220 for the control of ADF 400. Then, the copy start flag is set (step S511) to start the copying procedures.

Steps S513 to S517 are operations for starting the copying procedure. When copy start flag is set ("YES" at S513), the main motor, the developing motor, charger 6, and transfer charger 5*a* start to activate and, at the same time, the copy start flag is reset. Furthermore, timer A and timer B start, and also inter-image eraser 7*a* turns on (step S515). Furthermore, a clutch for the selected paper magazine engages (step S517) and feeding of copy papers starts.

Steps S519 to S521 are operations carried out when timer A counts up. Steps S523 to S535 are operations carried out when timer B counts up. When timer A counts a predetermined time from the copy start time ("YES" at step S519), copy paper feeding stops. When timer B counts a predetermined time from the copy start time ("YES" at step S523), scanning starts (step S525).

Furthermore, when single side filing mode is set ("YES" at step S527) to form a filing margin only on the leading end portion of copied image, timers 1 and 3 start (step S529). When timer counts up the time assigned thereto ("YES" at step S537), inter-image eraser 7*a* is turned off. Thereafter, inter-image eraser 7*a* is turned on again (see FIG. 15) after timer 3 counts up the time assigned thereto ("YES" at step S549).

When double sides filing margin mode is set ("YES" at step S531) to form the filing margins on the leading and trailing end portions of the copied image, timers 1 and 2 start (step S533). When timer 1 counts the predetermined time ("YES" at step S537), inter-image eraser 7*a* turns off (step S539) and thereafter inter-image eraser 7*a* turns on again (step S547, see FIG. 15) when timer 2 counts the predetermined time ("YES" at step S545).

When neither single filing margin mode nor double sides filing margin mode is set ("NO" at steps S527 and S531), a complete copied image without any erased portion is formed. In this case, inter-image eraser 7*a* is turned off. Then, timer 3 starts (step S535) and inter-image is activated to erase the intervals between the papers.

Steps S541 to S543 are operations carried out when optical scanner reaches the position on which switch SW500 is located. When the scanner reaches the above position of SW500, a timing signal is set ("YES" at step S541) and a clutch of timing roller pair 13 engages to feed a copy paper toward between photosensitive drum 2 and transfer charger 5*a*. Then, timer C starts.

Timer C is the timer to determine the scanning period. When timer C counts the time assigned thereto ("YES" at step S553), charger 6 is turned off; and the scanning completes. Also, the return flag is set and the clutch of timing roller pair 13 is disengaged (step S555).

Steps S557 to S569 are operations carried out when scanner returns to the home position. If multi-copy operation is not completed ("NO" at step S559) while the return flag is being set ("YES" at step S557), copy start flag is set, and return flag is cleared (step S565) to be ready for a further copying operation of the same document.

When multi-copy operation is finished ("YES" at step S559), scanner is observed to return to the home position by way of the predetermined position (on which switch SW501 locates). On reaching of scanner to the predetermined position ("YES" at step S561), the developing motor and transfer charger 5*a* are turned off and, at the same time, the return flag is cleared, and timer D starts (step S563).

Timer D is the timer to control the completion of copying operation of the machine. When timer D completes counting ("YES" at step S567), the main motor turns off (step S569).

(B) CPU 220 for the Control of ADF

<1> Main Routine

Figure 11:
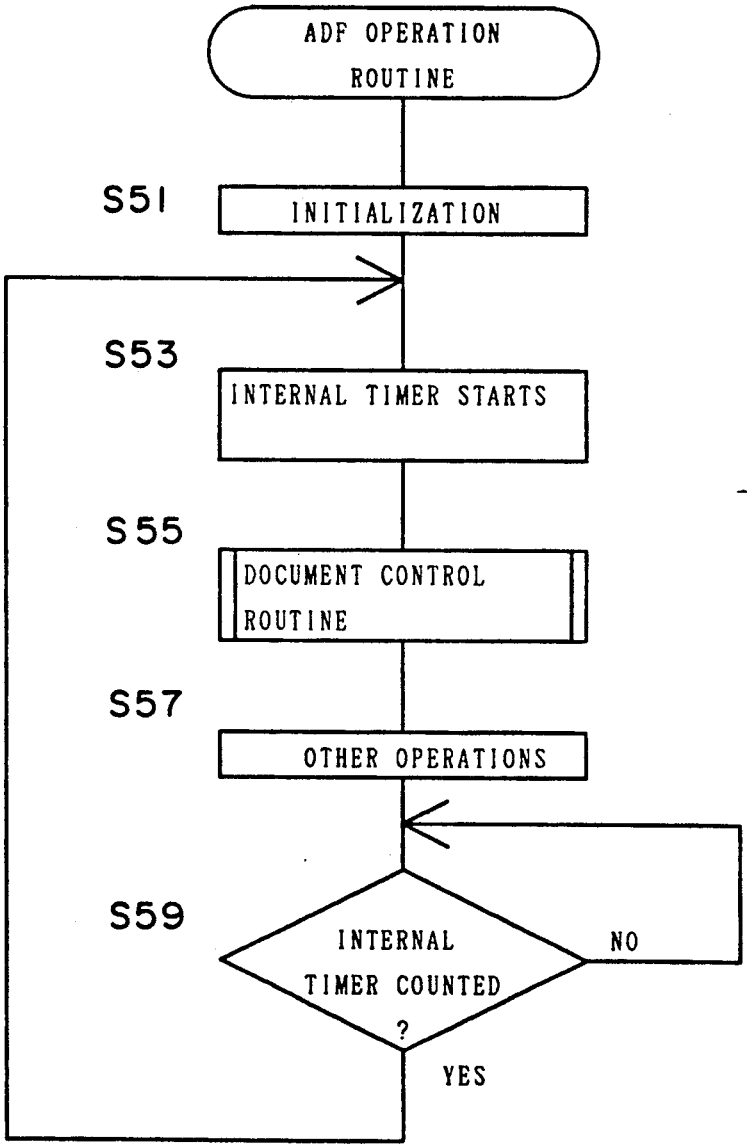
FIG. 11 is a flow chart of ADF operation mode routine to be executed by the CPU of the control unit of FIG. 4 to control the respective operations of the automatic document feeder of FIG. 1 of the present invention.

Referring to FIG. 11, a flow chart of operations carried out by CPU 220 for the control of ADF 400 is shown.

When the copying machine is connected to a power source, CPU 220 starts the initialization (step S51). Then, an internal timer for determining the cycle time of the routine starts (step S53) and then executes a document control routine (step S55) and other operations (step S57). After the foregoing routines are completed and internal timer started at step S53 has counted the time assigned thereto, the routine returns to step S53, and the same steps are repeated.

<2> Document Control Routine

Referring to FIG. 12, a flow chart of operations executed at step S55 is shown.

Steps S601 to S609 are operations to start document feeding. If ADF start signal from CPU 201 becomes one ( YES" at step S603, and see step S505) while documents are being set on document tray 405 ("YES" at step S601), document transporting belt driving motor 402 and document feeding roller driving motor 401 turn on (step S609), and then feeding of document begins.

When document feeding flag is set to one ("YES", see step S703), document feeding flag is reset (step S607), then document transporting belt driving motor 402 and document feeding roller driving motor 401 are turned on (step S609). Then after, feeding of the next document starts.

At step S611, document feeding operation is executed, the details thereof will be described later.

At step S613, it is judged whether or not the scanning for the required number of copies (in the case of multi-copying operation) has been completed. When it is judged that the required number of scanning is completed ("YES" at step S613), scan completion flag is set (step S615).

When the scanning completion flag is set ("YES" at step S617), document discharge operation is executed (step S621) after the scanning completion flag is reset.

<3> Document Feeding Operation Routine

Figure 13A:
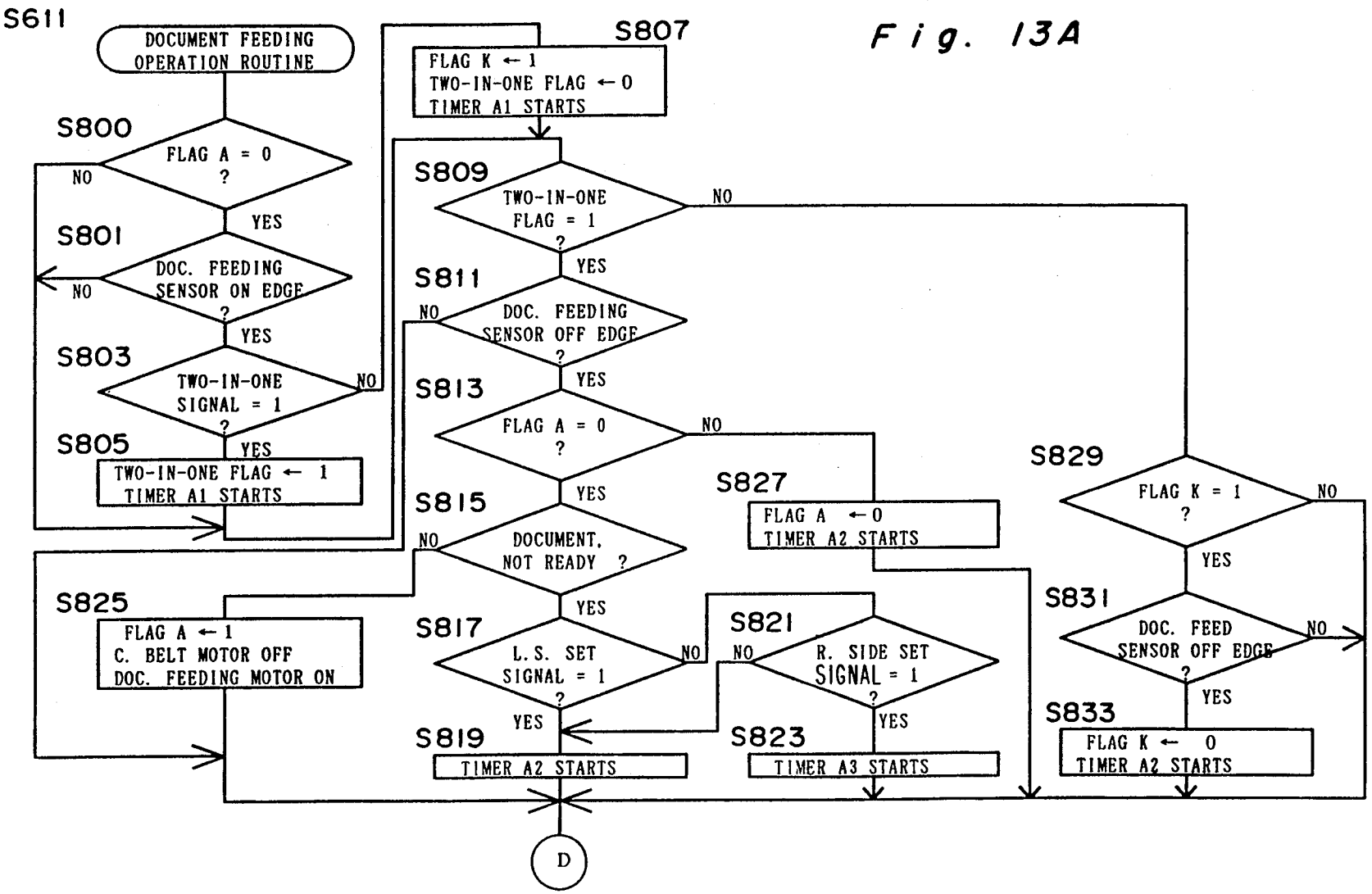
FIG. 13A and 13B are flow charts of feeding original document mode routine, shown in controlling original document mode routine of FIG. 12, of the present invention.
Figure 13B:
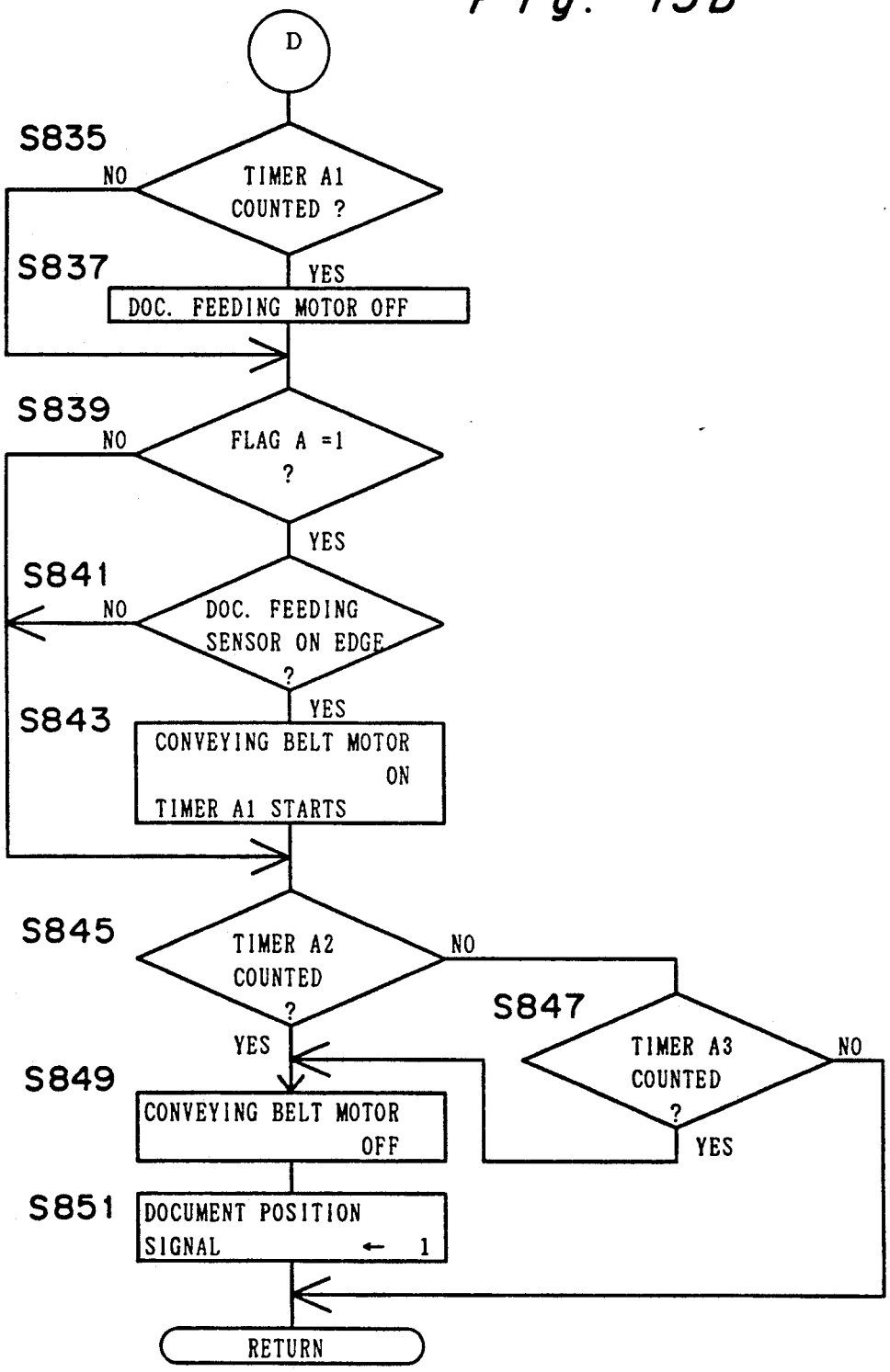

FIGS. 13A and 13B are flow charts of operations executed at step S611.

Steps S801 to S807 are operations executed after the feeding of a document sheet with odd number sheet (or after the feeding of document sheets under a mode other than two-in-one mode started). The document sheets are placed on document tray 405 facing down with the first page located at the bottom of document tray 405. Also the document sheets are fed from the top sheet in the document tray and, therefore the sheets are counted from the last page of the document sheets which are set in the document tray.

When flag A is zero ("YES" at step S800, flag A is zero at initial state), and when document sensor 410 detects "ON EDGE" ("YES" at step 801, it is judged whether tow-in-one signal is "1" or not at step S803). When the two-in-one mode signal is "1", namely the two-in-one mode is set ("YES" at step S803, see step S111), the two-in-one flag is set, and then timer A1 starts (step S805). Timer A1 is the timer to determine the time to turn document feeding roller driving motor 401 on.

When the mode is not two-in-one mode ("NO" at step S803, see step S107), two-in-one flag is reset, timer A1 starts and then, flag K is set (step S807).

Steps S811 to S827 are operations to control the feeding and stopping of the document under two-in-one mode. Under the two-in-one mode ("YES" at step S809), and when the "OFF EDGE" of document feed sensor 410 ("YES" at step S811) is detected, flag A is judged (at step S813). When flag A is zero ("YES" at step S813) indicating that the document sheet is an odd number sheet, flag A is set to one, provided that the document sheet is not the final document sheet ("NO" at step S815). Furthermore, document transporting belt driving motor 402 is turned off to quit the conveyance of the document temporarily and document feeding roller driving motor 401 is turned on to start the feeding of the next document sheet (even number sheet) (step S825).

When it is judged as no more document at step S815, that is, the detection at step S811 was the trailing edge of the final document ("YES" at step S815), and if at this stage either left side set signal is one or both left and right side set signals are zero ("YES" at step S817 or "NO" at steps S817 and S821), timer A2 starts (step S819). In this case, the final document is placed on adjacent the document scale S of glass platen 16.

When "no more document is ready for feeding" is judged at step S815 ("YES" at step S815) and further judged that the left side set signal is zero ("NO" at step S817) and right side set signal is one ("YES" at step S821), timer A3 starts (step S823). In this case, the final document is placed on the left half side of glass platen 16. (see steps S847 and S849).

When flag A is one at step S813 ("YES" at step S813), that is, the detection at step S811 was the trailing edge of the even number document sheet, flag A is reset to zero and then timer A2 starts (step S827). In this case, the odd number document sheet is placed on the left half of the glass platen and the even number document sheet is placed on the right half of the platen adjacent document scale S.

Steps S829 to S833 are operations to control the feeding and stopping of document sheets under a mode other than the two-in-one mode. When flag K indicating that a document sheet is being fed is set ("YES" at step S829) under a mode other than the two-in-one mode, flag K is reset and, at the same time, timer A2 starts (step S833) after the detection of "OFF EDGE" of document feed sensor 410 ("YES" at step S831). In this case, fed document sheet stops at a document scale S position (see steps S845 and S849).

Steps S835 to S851 are operations to turn off and on, in a predetermined sequence document feeding roller driving motor 401 and document transporting belt driving motor 402 which have been turned on and off during the above steps S809 to S833 and steps S609. In other words, document feeding roller driving motor 401 is turned off (step S837) in response to the count up timing of timer Al ("YES" at step S835).

Upon detection of the leading end of the next even number document sheet ("YES" at step S841) while flag A is still one ("YES" at step S839), document transporting belt driving motor 402 is turned on to start conveying two document sheets and then, timer Al starts (step S843).

Further, the document transporting belt driving motor 402 is turned off in response to the positioning of a document sheet to the right half area beside the document scale S of glass platen ("YES" at step S845), or to the positioning of a document sheet to the left half area of glass platen ("YES" at step S847). Furthermore, a document position signal indicating that the document sheet is placed at a predetermined position is transmitted to CPU 201 (step S851) and then copying operation starts (see steps S509 and S511).

<4> Document Discharge Operation Routine

Figure 14:
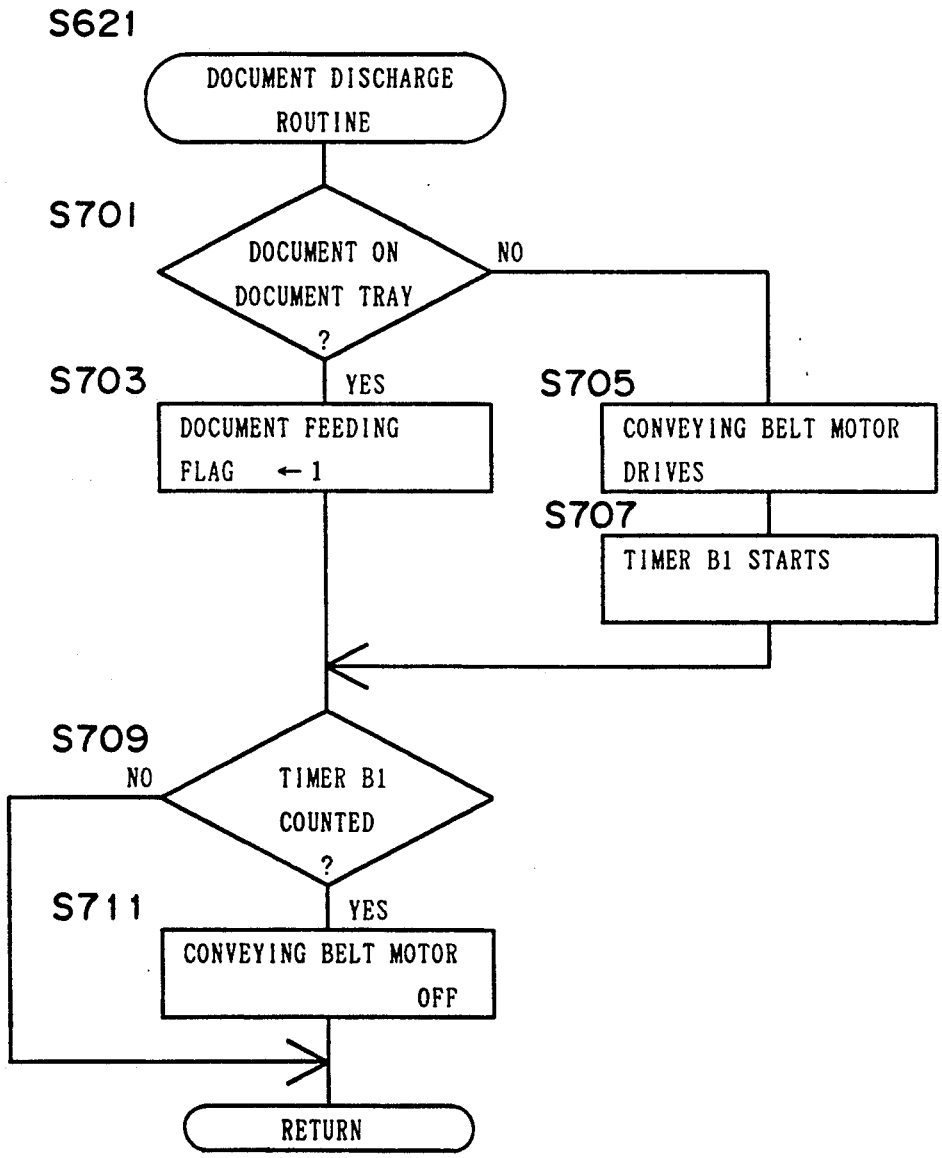
FIG. 14 is a flow chart of discharging original document mode routine, shown in controlling original document mode routine of FIG. 12, of the present invention.

Referring to FIG. 14, a flow chart of operations executed at step S621 is shown.

When another document sheet still exists in document tray 405 ("YES" at step S701), document feeding flag is set to one (step S703). Then the next document sheet is fed, and at the same time, the document on glass platen is discharged (see steps S605, S607 and S609).

When no more document is left in document tray 405 ("NO" at step S701), document transporting belt driving motor 402 is driven (step S705) to discharge the document sheet on glass platen 16. Time required for discharging the document sheet from glass platen 16 is controlled by timer B1 (steps S707, S709 and S711).

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A copying machine comprising:

a platen for supporting a document sheet to be copied, said platen having a first document loading area and a second document loading area;

a document tray for storing a plurality of document sheets;

document conveying means for successively feeding two document sheets from said document tray to said platen such that odd number sheets and even number document sheets are placed on said first and second document loading areas, respectively;

image forming means for forming an image of document sheets placed on said first and second document loading areas on first and second image recording areas, respectively;

set mode selecting means for selecting either one of first and second set modes; and first control means for controlling said document conveying means and said image forming means such that when the number of document sheets on said document tray is an odd number and said first set mode is selected by said mode selecting means, the final document sheet is set at said first document loading area of platen, and an image of said final document sheet is formed on said first image recording area, and when the number of document sheets on said document tray is an odd number and said second set mode is selected by said mode selecting means, the final document sheet is set at said second document loading area, and an image of said final document sheet is formed on said second image recording area.

2. A copying machine as claimed in claim 1, further comprising:

margin mode selecting means for selecting either one of first and second margin modes;

margin forming means for forming a first margin on one side of a copying material when said first margin mode is selected and for forming first and second margins on opposite sides of said copying material, respectively, when said second margin mode is selected; and second control means for controlling said set mode selecting means in accordance with the margin mode selected by said margin mode selecting means.

3. A copying machine as claimed in claim 2, wherein said first margin mode corresponds to either one of said first and second set modes, and said second margin mode corresponds to other one of said first and second set modes, and wherein said second control means automatically selects either one of said first and second set modes in relation to the selected margin mode.

4. A copying machine comprising:

a platen for supporting a document sheet to be copied;

a document tray for storing a plurality of document sheets;

document conveying means for successively feeding first and second document sheets from said document tray to said platen such that the first and second document sheets are positioned side by side;

image forming means for forming images of said first and second document sheets on first and second image recording areas; respectively;

set mode selecting means for selecting either one of first and second set modes; and first control means for controlling said document conveying means and said image forming means such that when the number of document sheets on said document tray is an odd number and said first set mode is selected by said mode selecting means, the final document sheet is set on said platen, and an image of said document sheet is formed on said first image recording area, and when the number of document sheets on said document tray is an odd number and said second set mode is selected by said mode selecting means, the final document sheet is set on said platen, and an image of said final document sheet is formed on said second image recording area.

5. A copying machine as claimed in claim 4, further comprising:

margin mode selecting means for selecting either one of first and second margin modes;

margin forming means for forming a first margin on one side of a copying material when said first margin mode is selected and for forming first and second margins on opposite sides of said copying material, respectively when said second margin mode is selected; and second control means for controlling said set mode selecting means in accordance with the margin mode selected by said margin mode selecting means.

6. A copying machine as claimed in claim 5, wherein said first margin mode corresponds to either one of said first and second set modes, and said second margin mode corresponds to other one of said first and second set modes, and wherein said second control means automatically selects either one of said first and second set modes in relation to the selected margin mode.

7. An automatic document feeding apparatus for setting document sheets on a platen having a first document loading area and a second document loading area, said apparatus comprises:

a document tray for storing a plurality of document sheets;

document conveying means for successively feeding two document sheets from said document tray to said platen such that odd number sheets and even number document sheets are placed on said first and second document loading areas, respectively, and discharging said first and second document sheets from said platen after exposing of said document sheets;

set mode selecting means for selecting either one of first and second set modes; and control means for controlling said document conveying means such that when the number of document sheets on said document tray is an odd number and said first set mode is selected by said mode selecting means, the final document sheet is set at said first document loading area, and when the number of document sheets on said document tray is an odd number and said second set mode is selected by said mode selecting means, the final document sheet is set at said second document loading area.

* * * * *